US008831449B2

(12) United States Patent
Suzuki et al.

(10) Patent No.: US 8,831,449 B2
(45) Date of Patent: Sep. 9, 2014

(54) IMAGE FORMING APPARATUS CAPABLE OF OPTIMALLY PERFORMING DENSITY FLUCTUATION CORRECTION

(71) Applicants: Shingo Suzuki, Kanagawa (JP); Satoshi Kaneko, Kanagawa (JP); Koichi Kudo, Kanagawa (JP); Shuji Hirai, Tokyo (JP); Shinji Kato, Kanagawa (JP); Jun Yamane, Kanagawa (JP)

(72) Inventors: Shingo Suzuki, Kanagawa (JP); Satoshi Kaneko, Kanagawa (JP); Koichi Kudo, Kanagawa (JP); Shuji Hirai, Tokyo (JP); Shinji Kato, Kanagawa (JP); Jun Yamane, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 8 days.

(21) Appl. No.: 13/645,785

(22) Filed: Oct. 5, 2012

(65) Prior Publication Data

US 2013/0108292 A1 May 2, 2013

(30) Foreign Application Priority Data

Nov. 2, 2011 (JP) ..... 2011-241007

(51) Int. Cl.
*G03G 15/22* (2006.01)
*G03G 15/00* (2006.01)

(52) U.S. Cl.
USPC ..... 399/49

(58) Field of Classification Search
CPC ..... G03G 15/5041; G03G 15/5058
USPC ..... 399/49
See application file for complete search history.

(56) References Cited

U.S. PATENT DOCUMENTS

| | | | | |
|---|---|---|---|---|
| 7,260,336 | B2 * | 8/2007 | Shimura et al. | 399/49 |
| 7,489,884 | B2 * | 2/2009 | Ichikawa et al. | 399/49 |
| 7,755,799 | B2 * | 7/2010 | Paul et al. | 358/1.9 |
| 2011/0229171 | A1 | 9/2011 | Hirai | |
| 2012/0201552 | A1 | 8/2012 | Hirai et al. | |

FOREIGN PATENT DOCUMENTS

| | | | |
|---|---|---|---|
| JP | 9-062042 | | 3/1997 |
| JP | 09062042 | A * | 3/1997 |
| JP | 2000-098675 | | 4/2000 |

* cited by examiner

*Primary Examiner* — Clayton E Laballe
*Assistant Examiner* — Leon W Rhodes, Jr.
(74) *Attorney, Agent, or Firm* — Harness, Dickey & Pierce, P.L.C.

(57) ABSTRACT

An image forming apparatus includes an image carrier; a developing device; a transfer device; and a fixing device. An electrostatic latent image formed on the image carrier is rendered visible as a toner image by depositing the toner by the developing device, and the toner image is transferred by the transfer device and fixed onto a recording medium by the fixing device and output. The apparatus further includes a density fluctuation meter including a rotary position detector, a density fluctuation detector, and a density fluctuation storage; a density fluctuation extractor unit including a first extractor, a second extractor, and a density fluctuation storage; and a control table generator unit including a control table generator and a control table storage, so that based on the control table stored in the control table storage, the voltage to be applied to the developing device is controlled and the toner image is output.

5 Claims, 20 Drawing Sheets

PHOTORECEPTOR CYCLE AVERAGE

IMAGE FORMING APPARATUS CAPABLE OF OPTIMALLY PERFORMING DENSITY FLUCTUATION CORRECTION

CROSS-REFERENCE TO RELATED APPLICATION

The present application claims priority from Japanese patent application number 2011-241007, filed on Nov. 2, 2011, the entire disclosure of which is incorporated by reference herein.

BACKGROUND OF THE INVENTION

1. Field of the Invention

The present invention relates to an image forming apparatus employing an electrophotographic method, such as a copier, a printer, or a facsimile machine, and in particular relates to an image forming apparatus capable of optimally correcting density fluctuations in an output image.

2. Description of the Related Art

An image forming apparatus employing an electrophotographic method forms an image by uniformly charging a photoreceptor or an image carrier by a charger, after which a latent image is formed on the photoreceptor by an exposure unit based on input image data and toner is adhered on the latent image by a developing device to thus render it a visual image. Such image forming apparatuses are widely used in the print industry and demand for ever higher quality is acute. To cope with such demand, high-speed image forming apparatuses have adopted various technologies.

Of those various quality requirements, uniform density over any given printed page is highly demanded and the uniformity in the printed page is a decision factor when a user selects an image forming apparatus. Fluctuation in the density within one page has various causes, such as unstable charge due to uneven charging; fluctuation of exposure by the exposure unit; variations in the sensitivity of the photoreceptor; variations in the resistance of a developing roller; fluctuation in the charge of the toner; and variations in the transferring of a transfer roller.

In the image forming apparatus employing the electrophotographic method, toner is deposited on the photoreceptor using an electrical field created by a potential difference between the developing roller or sleeve and the photoreceptor. It is generally known that the electrical field changes with distance. Specifically, when a developing gap fluctuates, the density also fluctuates. Because the density fluctuation caused by the rotary oscillation of the image carrier and the developing roller occurs cyclically and can be seen by the human eye, many customers raise claims for such a density fluctuation. In addition to the above factors, the density fluctuation from the oscillation of an intermediate transfer belt or uneven sensitivity of the photoreceptor varies, from the large cyclic density fluctuations to minute density fluctuations.

Various correction techniques have been proposed. Conventionally correction of the density fluctuation due to the rotary oscillation of the image carrier has been effective when the relative positions of the photoreceptor and the developing roller do not change from the time when the density fluctuation profile of one cycle of the photoreceptor is measured to correct the density fluctuation. However, when a print job is again executed after another print job has finished and the relative positions of the photoreceptor and the developing roller have changed, because the density fluctuation profile has changed, the density fluctuation cannot be corrected. Instead, a new density fluctuation occurs.

Even though the rotation cycles of the photoreceptor and the developing roller are set at an integral multiple of each other so that the density fluctuation profile becomes consistent. However, if the rotational speeds of the photoreceptor and the developing roller are different, the photoreceptor and the developing roller stop at different positions. Accordingly, it is difficult to keep the relative positions of the photoreceptor and the developing roller constant.

As a result, the density fluctuation cannot be prevented completely by simply measuring the density fluctuation and adjusting it with the rotational cycle of the photoreceptor, and a satisfactory correction effect cannot be obtained.

Herein, with reference to FIG. 20, a conventional density fluctuation correction method will now be described.

In the conventional density fluctuation correction method for correcting irregular rotary oscillation of the photoreceptor, it is first determined whether the density fluctuation correction is necessary or not. The necessity of the density fluctuation correction can be determined when the photoreceptor is replaced, when the photoreceptor detection position is shifted due to any reason, or optionally by the user mode. If it is determined that the density fluctuation correction is necessary, a detection pattern is formed so that the density fluctuation can be detected. The detection means in this case may be a density sensor or a density output on a sheet of paper. The detected density fluctuation data is averaged by the cycle of the photoreceptor, a phase and amplitude are adjusted so as to eliminate the density fluctuation, and the adjusted data is fed back as developing bias data. The fed-back developing bias is cyclically applied based on the relative positions of the developing roller and the photoreceptor. As described above, because the developing bias is corrected relative to the cycle of the photoreceptor, the density fluctuation due to the rotary oscillation of the photoreceptor is reduced.

FIGS. 21A and 21B are block diagrams each illustrating a device configuration for executing conventional density fluctuation correction.

As illustrated in FIG. 21A, a density fluctuation data storage includes reference density fluctuation data under specific image forming conditions. The density fluctuation data is data detected by a density sensor from an image previously formed by the image forming apparatus. Specifically, a data patch corresponding to 5 cycles of the photoreceptor is stored. A configuration in which data output on a sheet of paper is optically measured may also be used as density fluctuation data of the density fluctuation data storage.

A CPU converts the density fluctuation data of the storage into the correction data corresponding to the developing bias. The correction data is converted into analog signals by a D/A converter in synchronization with the photoreceptor rotary position detection signal, and the correction bias is applied to the developing roller from the developing bias high-voltage power supply so that the output image is controlled.

In a case in which the developing bias high-voltage power supply is PWM-controlled as illustrated in FIG. 21B, the correction data synchronizes with the photoreceptor rotary position detection signal and is PWM-controlled by the CPU. The correction bias is applied to the developing roller by the developing bias high-voltage power supply so that the output image is controlled.

FIG. 22 shows an example of the correction results executed by the conventional density fluctuation correction method. The vertical axis shows density fluctuation and a horizontal axis shows time elapsed in the photoreceptor rotation direction position. The white-out line shows a case in which the density fluctuation correction is not performed and the black line shows a case in which a correction is performed once.

JP-H09-62042-A discloses an image forming apparatus of the electrophotographic method or the electrostatic recording process for the purpose of exclusively reducing the stripe-shaped density fluctuation generated cyclically in the output image. The image forming apparatus disclosed includes a first fluctuation data storage to previously store the cyclical density fluctuations data of the image density; and a first controller to control the image forming condition based on the density fluctuations data, in which the first fluctuation data storage stores at least the density fluctuations data corresponding to one cycle of the developer carrier, and the first controller controls at least one of the charged voltage, the exposure light amount, the developer voltage, and the transfer voltage, whereby the density is corrected by the controller in accordance with the rotation cycle of the image carrier.

However, the conventional technology as described above cannot satisfactorily resolve the problem of density fluctuation due to the variation in the rotational cycle of the image carrier.

BRIEF SUMMARY OF THE INVENTION

The present invention solves the aforementioned problem in the conventional image forming apparatus and provides an optimal image forming apparatus capable of eliminating the density fluctuation that is cyclically generated due to oscillation of higher degree components of the rotational cycle of the image carrier, even though the relative phase of the image carrier and the developing roller may change.

More specifically, the present invention provides an image forming apparatus that includes: an image carrier; a developing device; a transfer device; and a fixing device, in which an electrostatic latent image formed on the image carrier is rendered visible as a toner image by depositing the toner by the developing device, the toner image is transferred by the transfer device and fixed onto a recording medium by the fixing device and output. The image forming apparatus further includes: a density fluctuation meter including a rotary position detector to detect a position of the image carrier in a rotation direction, a density fluctuation detector to detect the density fluctuation of the image carrier in the rotation direction, and a density fluctuation storage to store the density fluctuation detected by the density fluctuation detector; a density fluctuation extractor unit including a first extractor to extract the density fluctuation of the image carrier in the rotation direction based on the detected position by the rotary position detector from the density fluctuation stored by the density fluctuation storage, a second extractor to extract the density fluctuation for only the rotary cycle components by removing the density fluctuation component not caused by the rotary cycle of the image carrier from the density fluctuation of the image carrier in the rotation direction extracted in the first extractor, and a density fluctuation storage to store the extracted density fluctuation; and a control table generator unit including a control table generator to calculate a voltage to be applied to the developing device based on the density fluctuation data of one cycle of the image carrier stored in the storage, and a control table storage to store the generated control table, in which based on the control table stored in the control table storage, the voltage to be applied to the developing device is controlled and the toner image is output.

According to the image forming apparatus of the present invention, even though the relative phases of the photoreceptor and the developing roller change, the density fluctuation due to the oscillation of the rotation cycle and the higher frequency components of the rotation cycle of the photoreceptor can be removed from the existing density fluctuation. Accordingly, a high-quality image without any density fluctuation and with a uniform image density in one page can be output.

These and other objects, features, and advantages of the present invention will become more readily apparent upon consideration of the following description of the preferred embodiments of the present invention when taken in conjunction with the accompanying drawings.

DETAILED DESCRIPTION OF THE INVENTION

Hereinafter, preferred embodiments of the present invention will now be described with reference to accompanying drawings.

Figure 1:
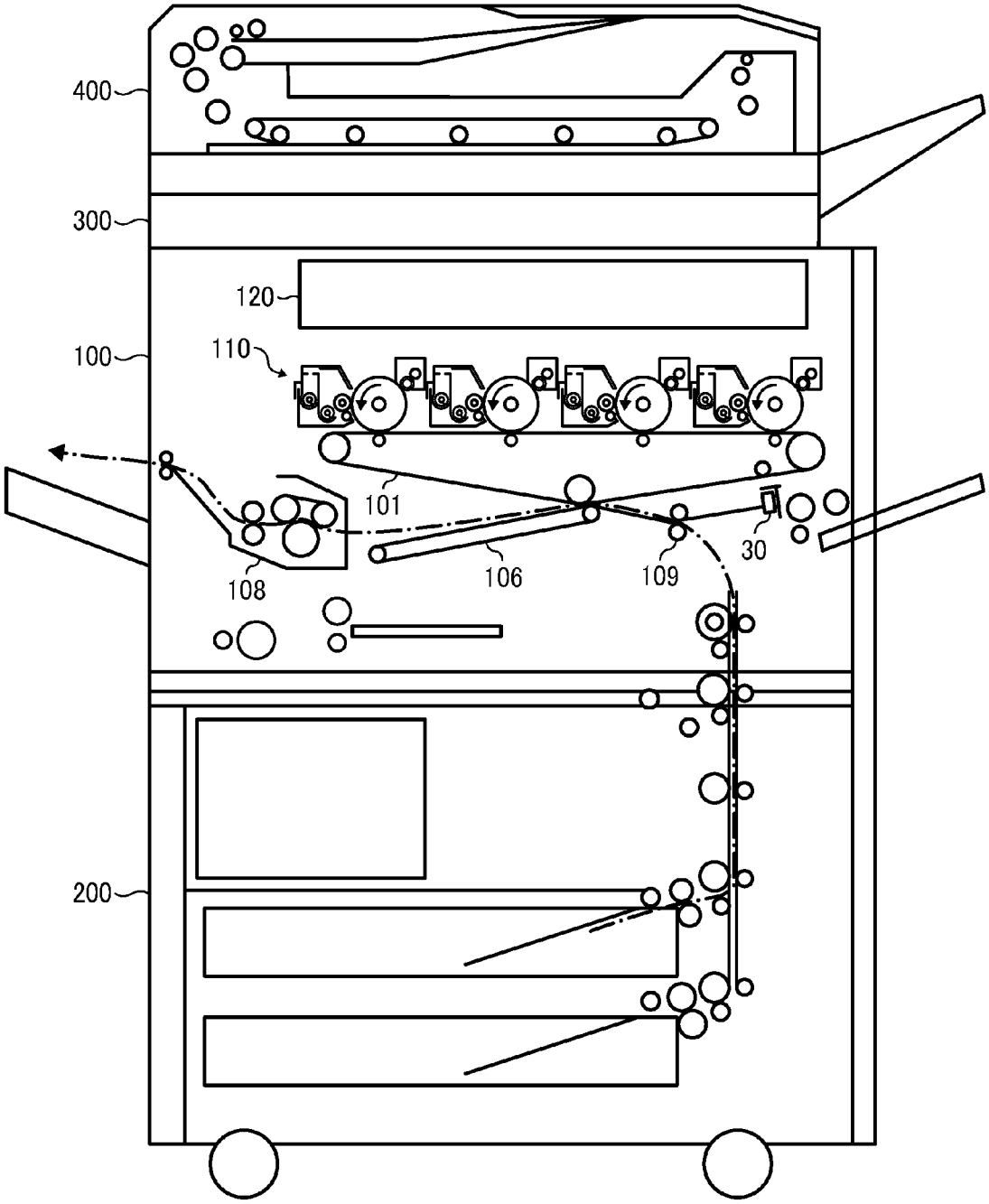
FIG. 1 is a cross-sectional view of an image forming apparatus according to an embodiment of the present invention.
Figure 2:
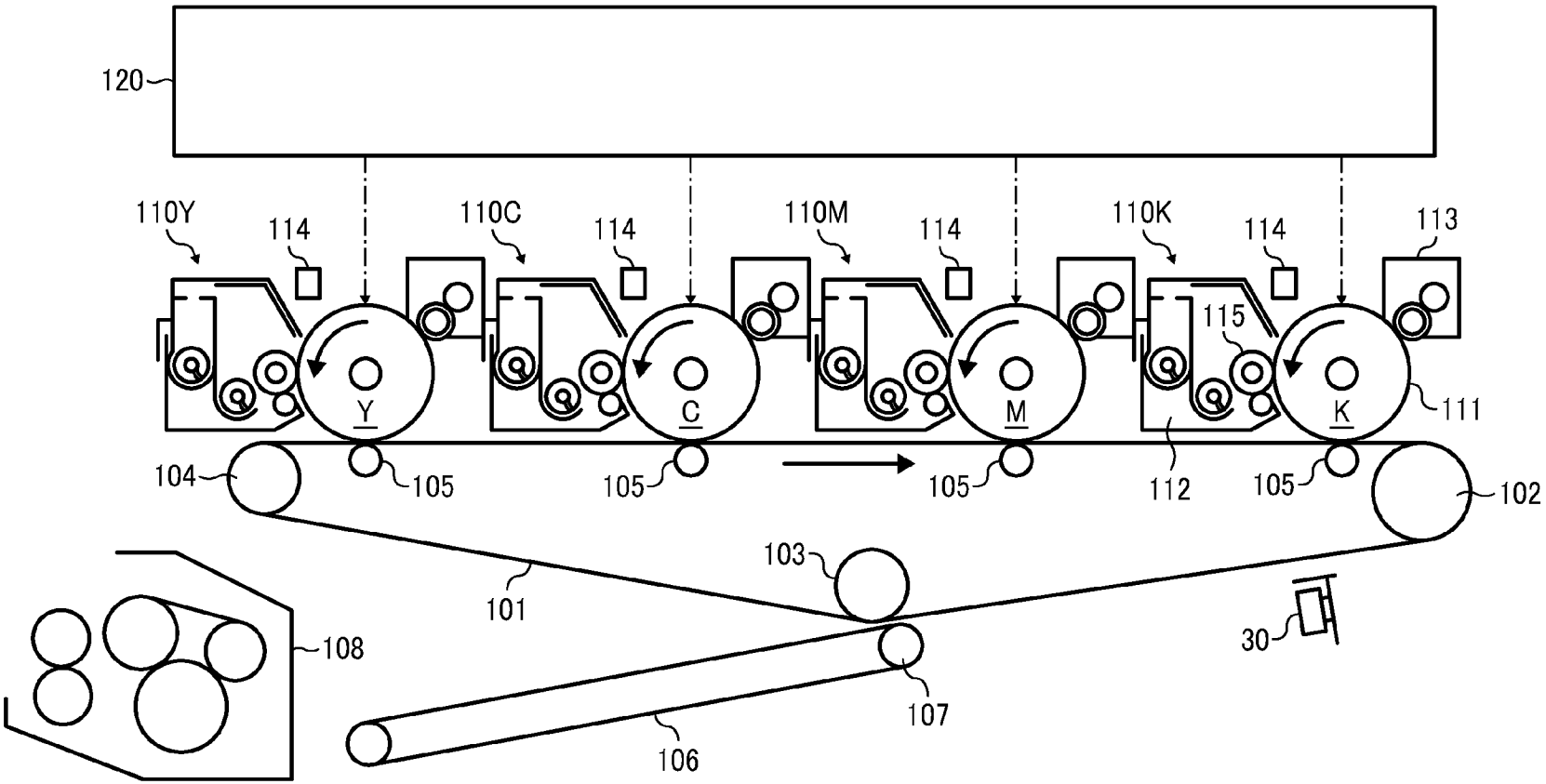
FIG. 2 is an enlarged partial view of an image forming unit of the image forming apparatus of FIG. 1.

FIG. 1 is a schematic cross-sectional view of an image forming apparatus according to an embodiment of the present invention. FIG. 2 is an enlarged partial view around an image forming unit of the image forming apparatus of FIG. 1. As illustrated in FIGS. 1 and 2, the image forming apparatus according to the embodiment of the present invention is configured as a copier and includes an apparatus body 100 in the center, a sheet feed unit 200 at a bottom of the apparatus, a scanner 300 at an upper part of the apparatus body 100, and an automatic document feeder (ADF) 400 above the scanner 300.

The apparatus body 100 includes a transfer unit, as a transfer means, configured such that an endless intermediate transfer belt 101 as a transfer member is stretched around a plurality of rollers. The intermediate transfer belt 101 is formed of materials in which less elastic polyimide resins are dispersed with carbon particles to adjust electric resistance. The intermediate transfer belt 101 is stretched around a driving roller 102 which is rotatably driven by a driving means, not shown; a secondary transfer backup roller 103; a driven roller 104; and four primary transfer rollers 105 (Y, C, M, and K), and is driven endlessly by the rotation of the driving roller 102 in the counterclockwise direction shown by an arrow as illustrated in FIG. 2. Image forming units 110 for the colors of yellow, cyan, magenta, and black (Y, C, M and K) are disposed side by side along an upper running surface of the intermediate transfer belt 101. Specifically, the four image forming units 110 disposed side by side form a tandem-type image forming unit.

In the present embodiment, each image forming unit 110Y, 110C, 110M, or 110K is disposed as a process unit detachably attachable to the image forming apparatus body. Each image forming unit 110 includes a photoreceptor drum 111, a latent image carrier contacting the intermediate transfer belt 101. Around each photoreceptor drum 111, a charger, a developing device, a cleaning device, and a discharger are disposed. Each image forming unit 110 handles different color of toner but is configured identical to each other. To simplify the figure, FIG. 2 shows the rightmost black image forming unit 110K only is attached with reference numerals of the photoreceptor drum 111, the developing device 112 and the cleaning device 113. The reference numeral 114 denotes a temperature/moisture sensor to detect the temperature and the moisture around the photoreceptor 111.

In the present embodiment, a rotary position detector, not shown, is disposed to each photoreceptor 111. The rotary position detector in the present invention is embodied as a sensor plate having a slit and engaged to an axis of the photoreceptor 111. The sensor plate rotates in association with the photoreceptor 111 and the slit in the sensor plate is detected by a permission-type photo-interrupter. The structure of the rotary position detector is not limited only to this, but any arbitrary structure such as a rotary encoder may be adopted as far as it can detect a rotary position.

An optical writing unit 120 is disposed above the image forming units 110Y, 110C, 110M, and 110K, for four colors of yellow, cyan, magenta, and black. The optical writing unit 120 emits four writing optical beams (as illustrated in FIG. 2 in the broken line) by driving four semiconductor lasers via a laser controller, not shown, based on image data. Then, each photoreceptor 111 of the image forming units 110Y, 110C, 110M, and 110K is scanned in the dark by the writing optical beams so that an electrostatic latent image for the colors of Y, C, M, and K is formed on the surface of each photoreceptor 111.

In the present embodiment, such an optical writing unit is used in which, while laser beams emitted from a semiconductor laser are being deflected by a polygon minor, not shown, the deflected laser beams are reflected by a reflection mirror or are penetrated into an optical lens, so that optical scanning is performed. As an optical writing unit, the one executing the optical scanning by LED arrays may be used instead.

The electrostatic latent image written onto the photoreceptor 111 is developed by that toner existing in the developing device is deposited on the photoreceptor by the electrostatic adhering power. Thereafter, each toner image is sequentially overlaid on the intermediate transfer belt 101, so that a desired full-color toner image is formed thereon.

At a predetermined timing, a recording sheet is conveyed by a registration roller pair 109 to a secondary nip portion where a roller 107 and an opposed roller 103 forming a secondary transfer position are opposed to each other, receives en bloc the four-color toner image overlaid on the intermediate transfer belt 101, and is conveyed by a conveyance belt 106. Then, the recording sheet passes through a fixing unit 108 at which the toner image is fixed thereon to be a color printed image, and is discharged outside the apparatus.

The image forming apparatus further includes a nonvolatile memory and volatile memory, not shown, configured to store various data such as output data from each sensor and correction control results data.

A toner deposition amount sensor 30, which in the present embodiment is a density sensor, is disposed downstream of the black image forming unit 110 disposed most downstream of the tandem image forming unit in the conveyance direction of the intermediate transfer belt 101. An arbitrary toner deposition amount sensor may be employed, but the optical sensor as illustrated in FIG. 3 is used in the embodiment of the present invention.

Figure 3A:
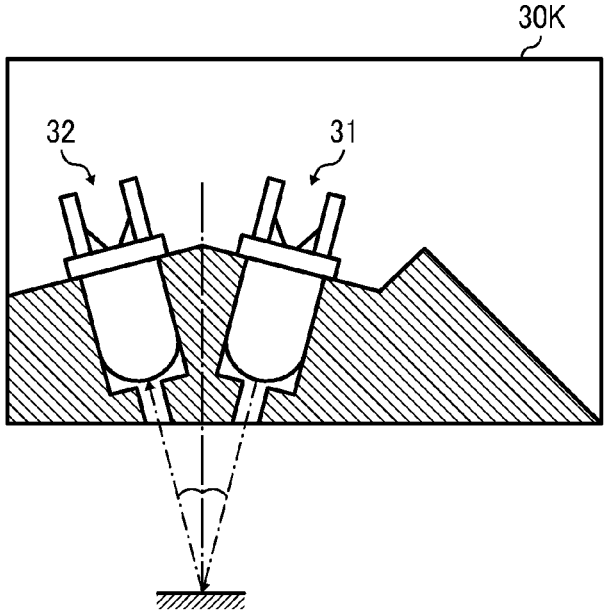
FIGS. 3A and 3B each are schematic views of a toner deposition amount sensor as a density sensor.
Figure 3B:
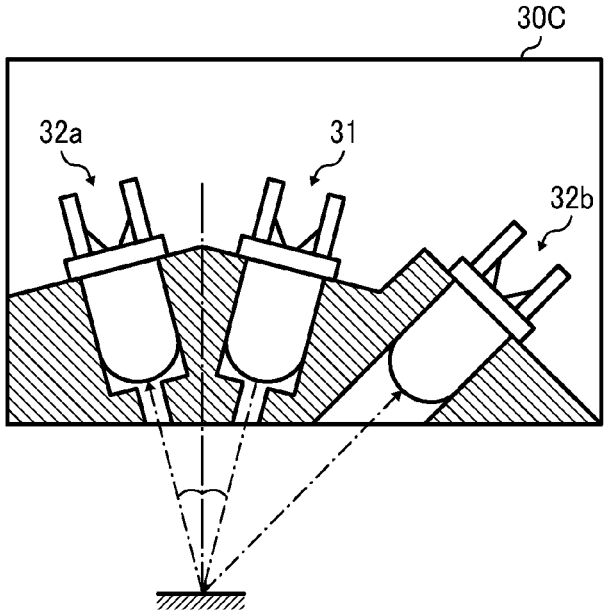

FIG. 3A shows a configuration of the black toner deposition amount sensor to detect deposition amount of the black toner and FIG. 3B shows a configuration of the color toner deposition amount sensor to detect deposition amount of the toner other than the black color. As illustrated in FIG. 3A, the black toner deposition amount sensor 30K includes a light emitting element 31 such as a light emitting diode (LED) and a light receiving element 32 to receive specular reflected light. The light emitting element 31 irradiates the intermediate transfer belt 101 with light and the irradiated light is reflected by the intermediate transfer belt 101. The light receiving element 32 receives only the specular reflected light among the reflected light.

On the other hand, as illustrated in FIG. 3B, the color toner deposition amount sensor 30C includes a light emitting element 31 that includes a light emitting diode (LED), a light receiving element 32*a* to receive the specular reflected light, and a light receiving element 32*b* to receive diffused reflected light. The light emitting element 31 the intermediate transfer belt 101 with light as the black toner deposition amount sensor 30K does. The irradiated light is reflected by the surface of the intermediate transfer belt 101. The light receiving element 32*a* that receives only the specular reflected light among the reflected light and the diffused reflected light receiving element 32*b* receives the diffused reflected light among the reflected light.

In the present embodiment, the light emitting element 31 employs a GaAs infrared light emitting diode having a peak wavelength 950 nm of the emitted light and the light receiving element 32, 32*a*, and 32*b* employ a S1 photo transistor having a peak light receiving sensitivity of 800 nm. However, the present invention is not limited to these values and the peak wavelength and the peak light receiving sensitivity may be different from the above values. In addition, there is a gap of some 5 mm between the black toner deposition amount sensor 30K or the color toner deposition amount sensor 30C and the intermediate transfer belt 101 as a detection target. In addition, it is to be noted that, in the present embodiment, the toner deposition amount sensor 30 is disposed in the vicinity of the intermediate transfer belt 101 and image formation conditions are defined based on the toner deposition amount on the intermediate transfer belt 101. However, the toner deposition amount sensor 30 may be disposed on the photoreceptor 111 or the conveyance belt 106. An output from the toner deposition sensor 30 is converted to a deposition amount by a well-know deposition amount conversion algorithm.

Figure 4A:
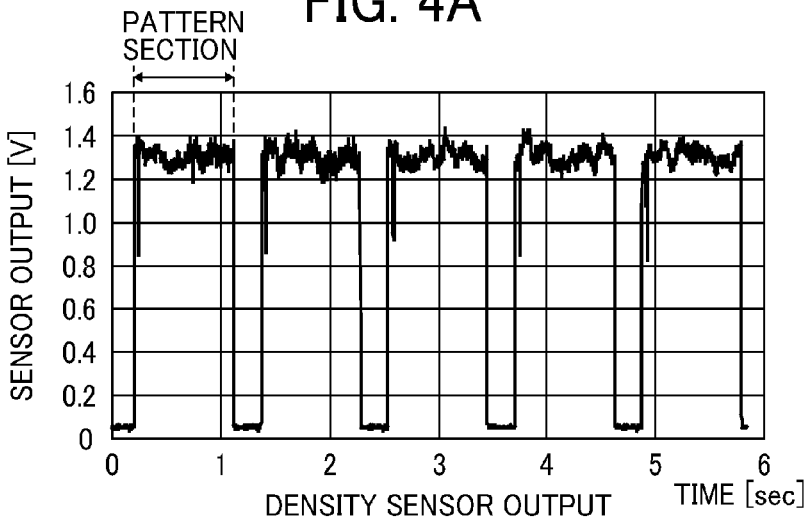
FIGS. 4A and 4B are graphs each illustrating an example of density fluctuation due to rotary oscillation of the photoreceptor.
Figure 4B:
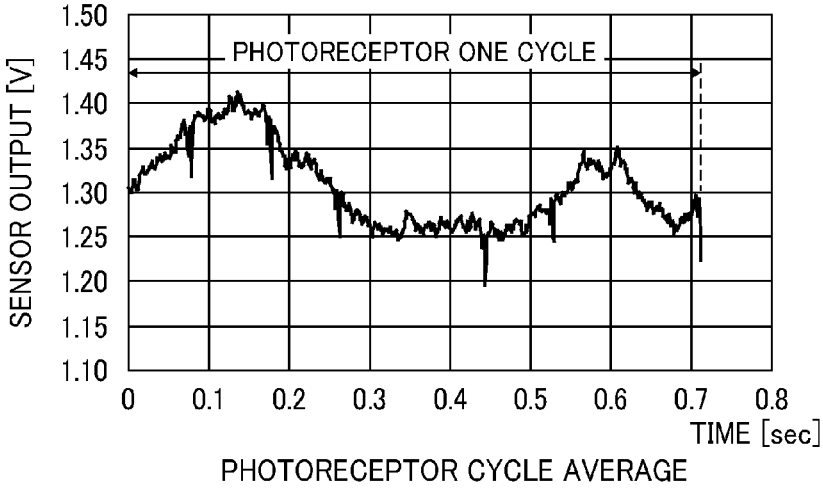

FIGS. 4A and 4B are graphs each illustrating an example of density fluctuation due to rotary oscillation of the photoreceptor.

Figure 5:
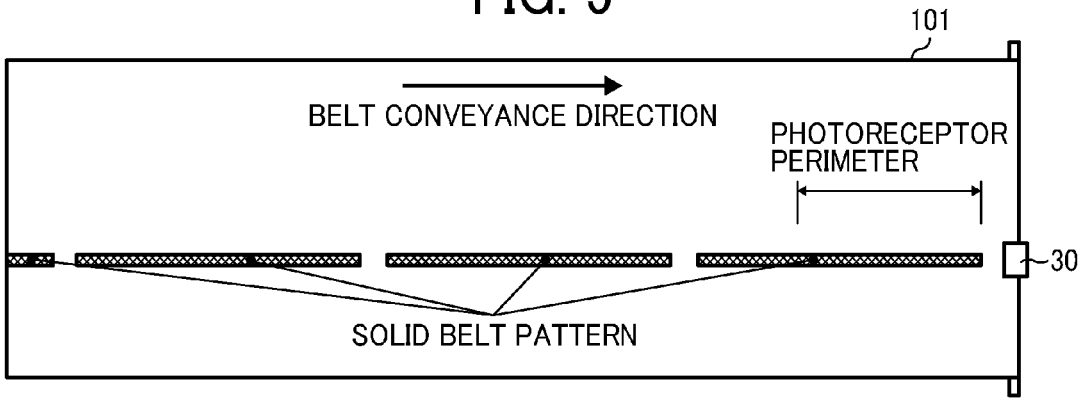
FIG. 5 is a schematic view illustrating an example of a density fluctuation detection pattern.

In the graphs of FIGS. 4A and 4B, a vertical axis shows density sensor output and a horizontal axis shows an elapsed time. To confirm that the density fluctuation in the sub-scanning direction depends on the rotation of the photoreceptor, elongated belt-shaped patterns in the sub-scanning direction are created as illustrated in FIG. 5 by using an image forming apparatus as shown in FIG. 1, and the belt-shaped pattern is measured by the density sensor, that is, the toner deposition sensor 30. The belt-shaped pattern has a length in the sub-scanning direction longer than that of the perimeter of the photoreceptor. The diameter of the photoreceptor used in the present experiment is ϕ100 mm, process linear speed is 440 mm/s, and charging, developing, and LD power is set to −700V, −500V, and 70%, respectively, and a belt-shaped pattern of cyan 100% was formed.

Because the belt-shaped pattern is formed by the cyan color, the sensor output as shown in FIG. 4A is diffused reflected output of the color toner deposition amount sensor 30C. From the graph, it is confirmed that the density fluctuation occurs in the pattern section.

The graph in FIG. 4B is an average density sensor output of the 5 cycles of the photoreceptor, in which the density sensor output of the pattern sections in FIG. 4A are divided by the photoreceptor cycle using the photoreceptor rotary position detection signal as a reference. From FIG. 4B, it is clear that a cyclical fluctuation occurs in the photoreceptor rotary cycle. Because the fluctuation in the density sensor output signifies fluctuation in the toner deposition amount, it is understood that the image density fluctuates during the photoreceptor rotary cycle.

Next, a structure for and a method of executing the density fluctuation correction in the present image forming apparatus will now be described in first to fifth embodiments.

Figure 6:
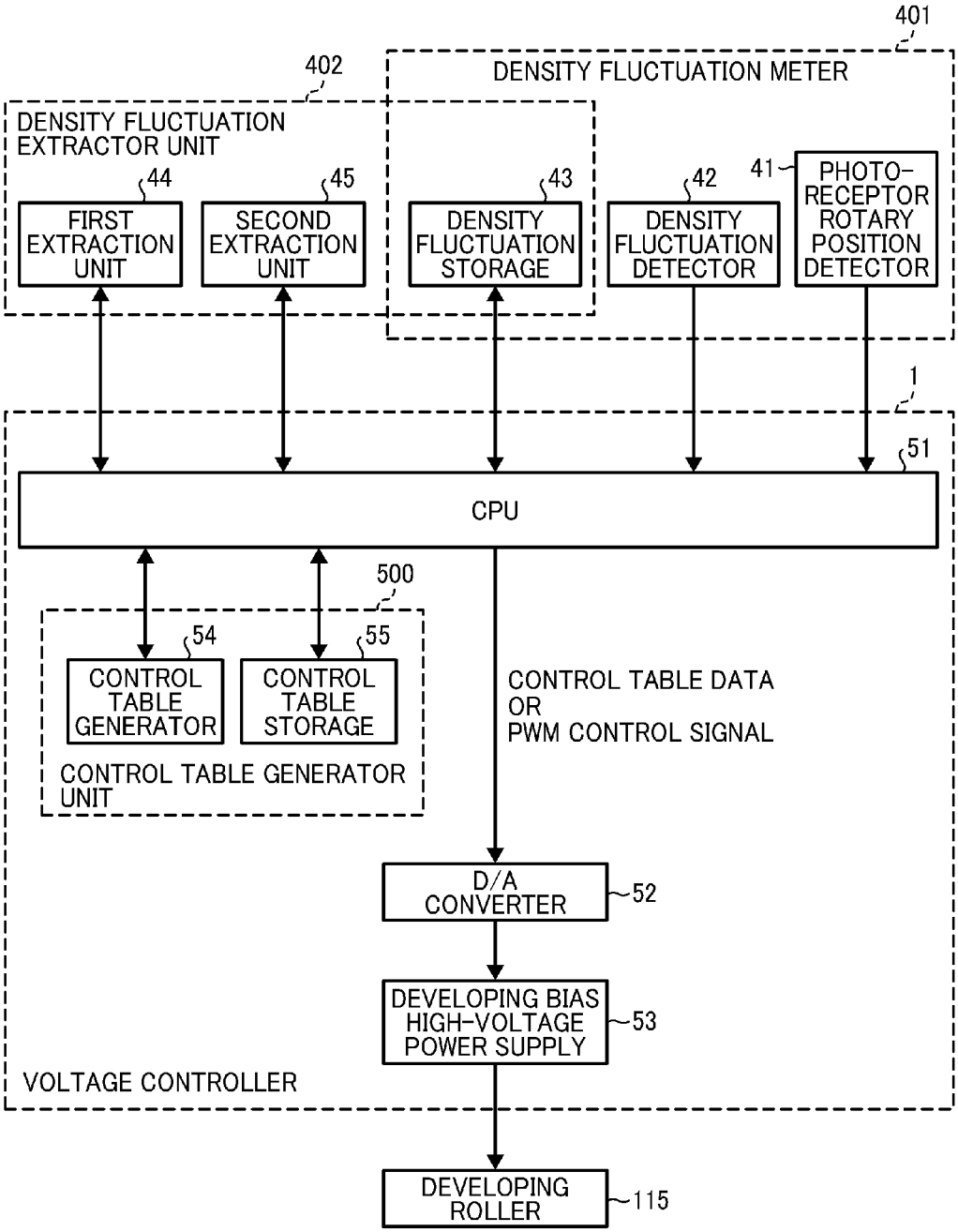
FIG. 6 is a block diagram illustrating a structure of a first embodiment for executing a density fluctuation correction.

FIG. 6 is a block diagram illustrating a structure of a unit for executing density fluctuation correction according to a first embodiment of the present invention.

In FIG. 6, the density fluctuation correction means includes a density fluctuation meter 401 to measure the density fluctuation of the photoreceptor in the rotation direction and a density fluctuation extractor unit 402 to extract the density fluctuation of the cyclic components due to the rotary cycle of the photoreceptor.

The density fluctuation meter 401 includes a rotary position detector 41 to detect a reference rotary position of the photoreceptor; a density fluctuation detector 42 to detect a density fluctuation in the rotary direction of the photoreceptor; and a density fluctuation storage 43 to store the detected density fluctuation.

The density fluctuation extractor 402 includes a first extraction unit 44 to extract a density fluctuation of each rotary cycle of the photoreceptor from the stored density fluctuation; a second extraction unit 45 to extract density fluctuation including only the rotary cycle component upon removing the density fluctuation not caused by the rotary cycle from the extracted density fluctuation of each rotary cycle of the photoreceptor; and a density fluctuation storage 43 to store the extracted density fluctuation. The storage 43 is commonly used for the storage of the density fluctuation meter 401 in the present embodiment.

The voltage controller 1 includes a control table generator unit 500 and a developing bias output controller. The control table generator unit 500 includes a control table generator 54 to generate a control table to correct the developing bias based on the extracted density fluctuation profile and a control table storage 55 to store the generated control table.

Further, the developing bias output controller includes a D/A converter 52 to exert a D/A conversion as to the output voltage based on the stored control table data and a high voltage power supply 53 to output a developing bias. When the output from the high-voltage power supply 53 is controlled by the PWM control signal, the developing bias output controller includes a PWM control signal generator to control the output voltage based on the stored control table data and a high-voltage power supply to output a developing bias.

More specifically, the developing bias output controller includes a CPU 51; the D/A converter 52; the developing bias high-voltage power supply 53; a memory as a storage, and generates a density fluctuation correction signal (i.e., correction data) from the data including a density sensor detection signal (of the density fluctuation detector 42) and a photoreceptor rotary position detection signal (of the photoreceptor rotary position detector 41) and controls the developing bias to be applied to the developing roller based on the photoreceptor rotary position detection signal. The CPU 51 to control the voltage controller 1 controls for example the developing bias output (that is, D/A conversion output or PWM control signal output), density sensor detection signal input (A/D conversion), photoreceptor rotary position detection signal input, control table calculation operation, read/write to and from the memory, correction frequency count, time count by a timer, temperature/moisture sensor detection signal input (A/D conversion), and the like. The density fluctuation data and the density fluctuation correction data are sequentially stored in the density fluctuation data storage 43 and the control table storage 55.

Next, a density fluctuation correction process according to the first embodiment will now be described with reference to a flowchart of FIG. 7.

First, whether density fluctuation correction is necessary or not is determined in step S1. The time for determining the necessity of the density fluctuation correction can be selected, for example, when the photoreceptor is replaced, when the photoreceptor detection position is shifted due to any reason, or optionally by the user mode. Alternatively, the density fluctuation correction can be executed when there is a marked change in use environment, when the apparatus is initially turned on, or when the density fluctuation correction is previously determined to be necessary.

If it is determined that the density fluctuation correction is necessary, the belt-shaped pattern (detection patch) is generated in step S2 and the density fluctuation detector 42 detects a density fluctuation (step S3). In this case, the detection by the density fluctuation detector 42 may be executed by the density sensor (that is, the toner deposition amount sensor 30 in FIG. 1) or may be executed by a structure to detect the image density on the output sheet of paper.

The detected density fluctuation data is extracted by the rotary cycle of the photoreceptor based on the rotary position detection signal of the photoreceptor in the rotation direction in step S4.

Next, any density fluctuation component not caused by the rotary cycle of the photoreceptor is removed from the extracted density fluctuation of the photoreceptor rotary cycle, and the density fluctuation component due to the rotary cycle of the photoreceptor is extracted in step S5. Various methods are available to accomplish this extraction. For example, there is one method in which a belt-shaped pattern is formed, and in detecting the density fluctuation, a phase relation between the photoreceptor and the developing roller is changed, the detected density fluctuation data is superimposed and is subject to an averaging process. There is another method in which the density fluctuation data extracted by the photoreceptor rotary cycle is subjected to fast Fourier transformation (FFT) process or orthogonal waveform detection process, an amplitude and a phase of the n-th component of the photoreceptor basic rotary cycle are obtained, and only the density fluctuation component due to the photoreceptor cycle only is extracted from the synthesized waveform of the n-th component of the photoreceptor basic rotary cycle.

The density fluctuation data of one cycle of the photoreceptor due to the extracted photoreceptor rotary cycle is stored in the memory (that is, the density fluctuation storage 43) in step S6.

In order to control the developing bias to be applied to the developing roller according to the density fluctuation, the stored density fluctuation data of one cycle of the photoreceptor is converted to a parameter to control the output voltage of the development high-voltage power supply and is stored as a control table to the memory (that is, the control table storage 55) in steps S7 and S8. A duty value of the PWM control signal or a count value to be set in a register of the CPU when the PWM control is performed, and a voltage setting value to control the high-voltage power supply when analog control is performed are considered as a parameter to control the high-voltage power supply.

Based on the generated control table, the developing bias is controlled or corrected by the photoreceptor rotary cycle according to the density fluctuation so that an output image from which the density fluctuation due to the photoreceptor rotary cycle is removed is formed in step S9.

Figure 8:
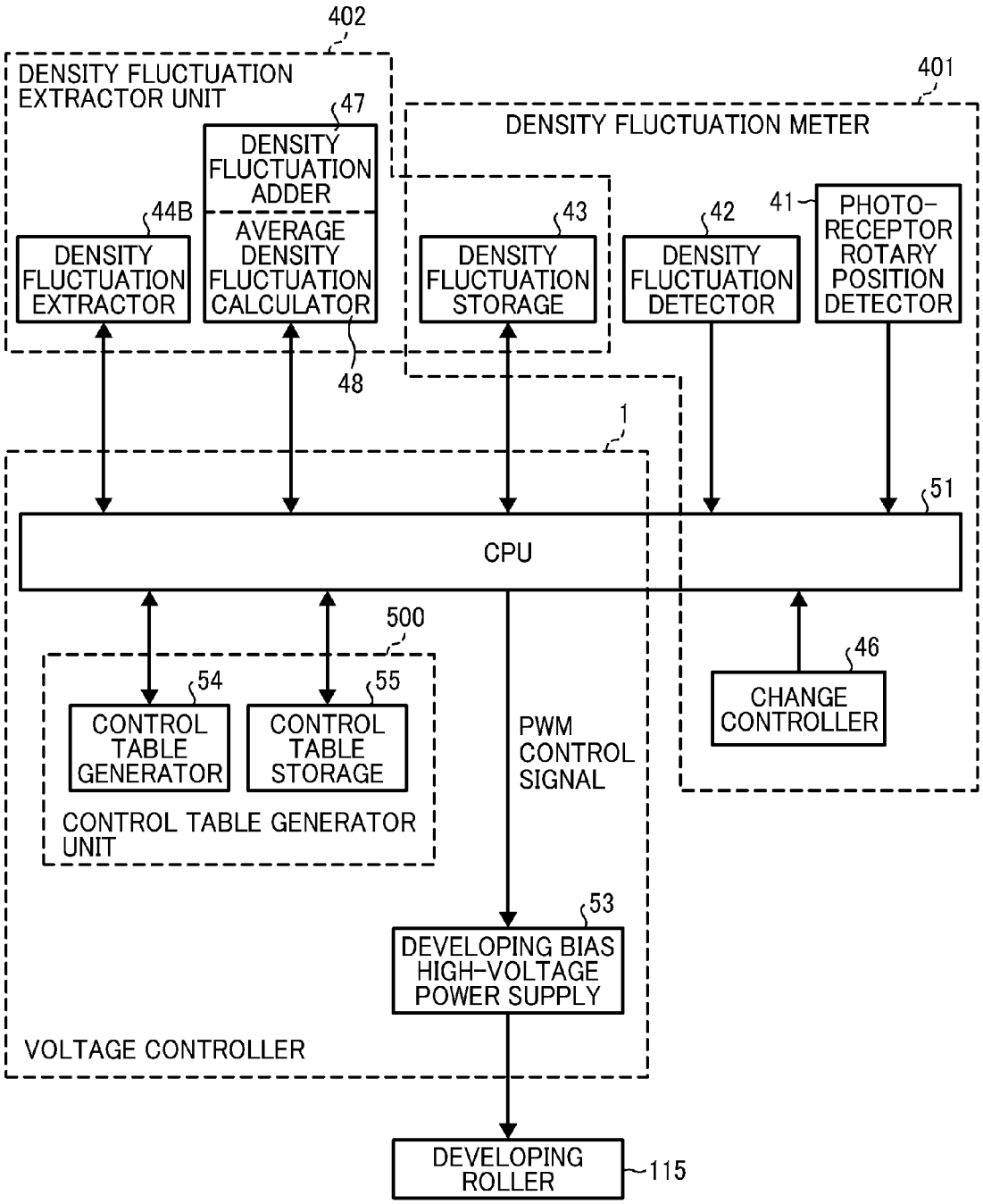
FIG. 8 is a block diagram illustrating a structure of a second embodiment for executing a density fluctuation correction.

FIG. 8 is a block diagram illustrating a structure of a second embodiment for executing a density fluctuation correction.

In FIG. 8, the density fluctuation correction means includes the density fluctuation meter 401 to measure the density fluctuation of the photoreceptor in the rotation direction, the density fluctuation extractor unit 402 to extract an average density fluctuation due to the rotary cycle, and a change controller 46 to change a relative position of the photoreceptor and the developing roller.

The density fluctuation meter 401 is configured as in the first embodiment described above and includes the photoreceptor reference rotary position detector 41, the density fluctuation detector 42 to detect the density fluctuation in the rotation direction of the photoreceptor, and the density fluctuation storage 43 to store the detected density fluctuation.

The density fluctuation extractor unit 402 includes a density fluctuation extractor 44B to extract density fluctuation of each rotary cycle of the photoreceptor based on the rotary position detection signal of the photoreceptor in the rotation direction from the stored density fluctuation for several rotary cycles of the photoreceptor; a density fluctuation adder 47 to superimpose the extracted density fluctuation profiles for each photoreceptor rotary cycle; an average density fluctuation calculator 48 to calculate an average density fluctuation profile for one cycle of the photoreceptor from the superimposed density fluctuation profile; and the storage 43 to store the calculated density fluctuation.

Further, the change controller 46 changes relative positions of the photoreceptor and the developing roller each time the measurement is performed when the density fluctuation of the photoreceptor in the rotation direction is measured several times. For example, either the photoreceptor or the developing roller is rotated a little before starting the measurement.

Because the voltage controller 1 and the control table generator unit 500 are identical to the first embodiment, the description thereof will be omitted.

Figure 9:
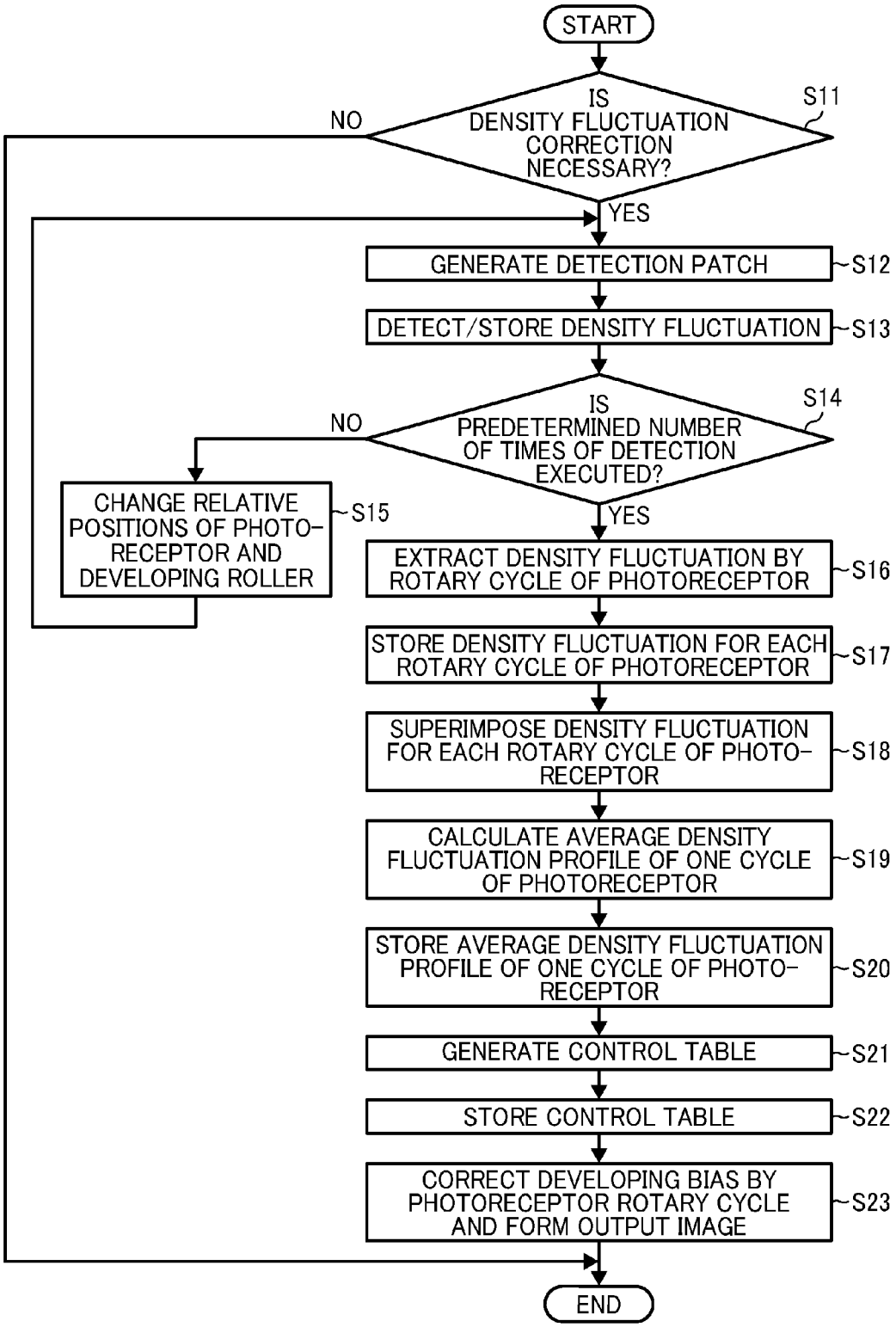
FIG. 9 is a flowchart illustrating a correction process in the second embodiment.

Next, a density fluctuation correction process according to the second embodiment will now be described with reference to a flowchart in FIG. 9.

Figure 7:
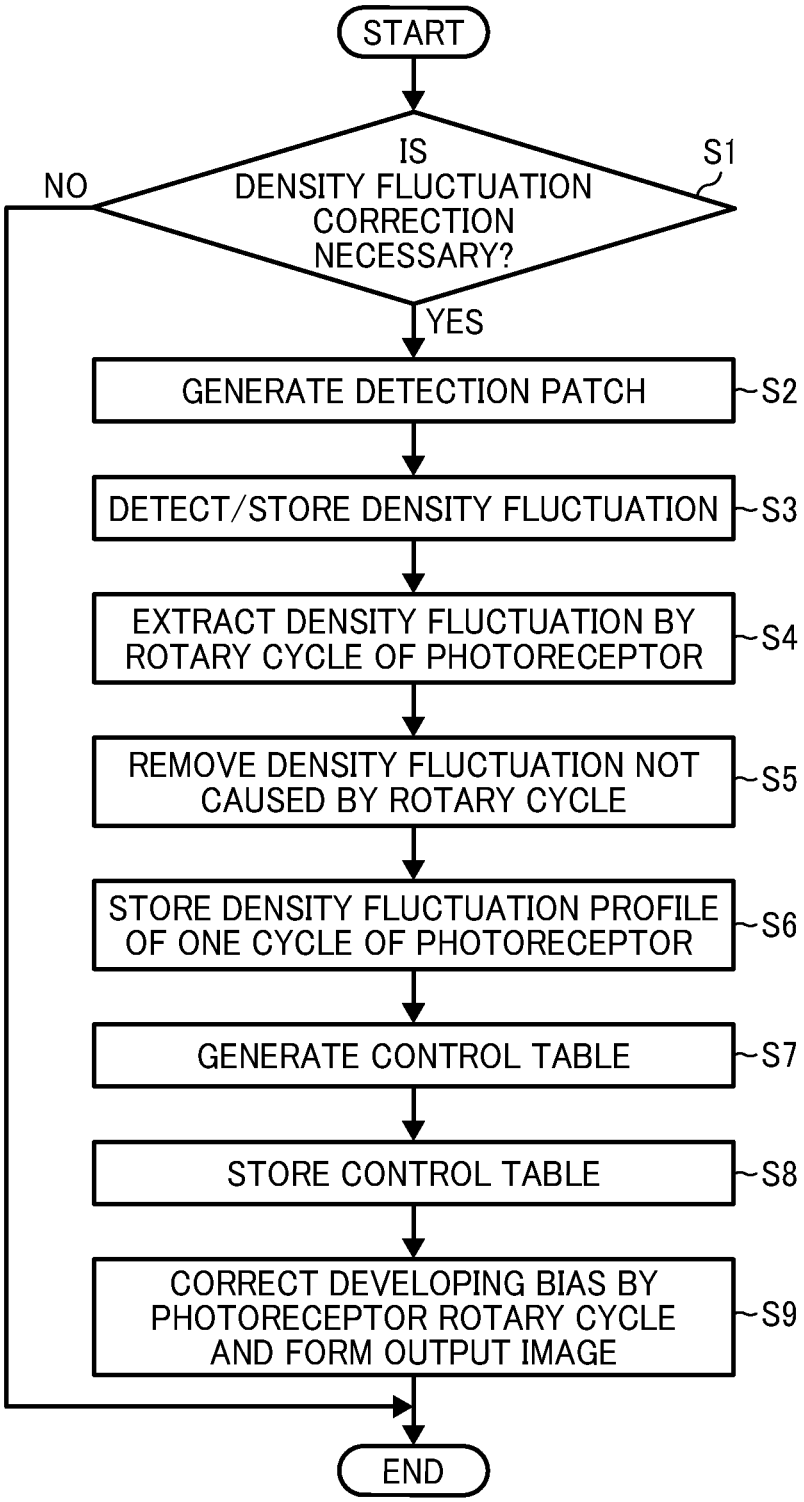
FIG. 7 is a flowchart illustrating a correction process in the first embodiment.

First, whether a density fluctuation correction is necessary or not is determined in step S11, which is identical to step S1 in FIG. 7.

If it is determined that the density fluctuation correction is necessary, the belt-shaped pattern (detection patch) is generated in step S12 and the density fluctuation is detected. The detection means in this case may be a density sensor similar to the case of the first embodiment or a structure in which a density output on a sheet of paper is detected. The detected density fluctuation data is extracted and stored such that the position of the photoreceptor in the rotation direction can be recognized based on the rotary position detection signal of the photoreceptor in the rotation direction in step S13.

After the density fluctuation is detected and the data is stored, relative positions of the photoreceptor and the developing roller are changed, the belt-shaped pattern is formed again in a similar manner, and the density fluctuation is detected. In order to change the relative positions of the photoreceptor and the developing roller, for example, the photoreceptor and the developing roller are temporarily stopped and either of them is rotated a little. After the photoreceptor and the developing roller have been again driven, the belt-shaped pattern is generated and the density fluctuation is detected. The method to change the relative positions of the photoreceptor and the developing roller is not limited to this, but any method capable of changing the relative positions may be used. The detected density fluctuation data is extracted and stored such that the position of the photoreceptor in the rotation direction can be recognized based on the rotary position detection signal of the photoreceptor in the rotation direction.

Thus, the relative positions of the photoreceptor and the developing roller are changed and the density fluctuation data is detected up to a predetermined number of times, and at least the density fluctuation of one cycle of the photoreceptor is detected for each measurement and is stored. In the flowchart, the number of times is checked in step S14, and relative positions of the photoreceptor and the developing roller are changed in step S15.

The detected density fluctuation data is extracted by the rotary cycle of the photoreceptor based on the rotary position detection signal of the photoreceptor in the rotation direction in step S16 and is stored in the memory or storage 43 in step S17.

In step S18, the density fluctuation profile for each rotary cycle of the photoreceptor is extracted based on the rotary position detection signal of the photoreceptor in the rotation direction from the stored density fluctuation of the several rotations of the photoreceptor, the density fluctuation profiles each having a different phase between the photoreceptor and the developing roller extracted each time the photoreceptor rotary cycle are superimposed in step S18. Then, from the superimposed density fluctuation profiles, the average density fluctuation profile for one cycle of the photoreceptor is calculated in step S19. The average density fluctuation profile of one cycle of the photoreceptor due to the calculated photoreceptor rotary cycle is stored in the memory 43 in step S20.

Herein, for example, when the rotary cycle of the photoreceptor and the developing roller is an integral multiple, the density fluctuation of the rotary cycle formed by the photoreceptor and the developing roller overlaps at a matched position of the integral multiple and cannot be divided. In such a case, the relative positions of the photoreceptor and the developing roller are changed so that the density fluctuation profile of which phase is different each time is obtained and superimposed so as to be averaged. As a result, because amplitude of the density fluctuation component other than the photoreceptor rotary cycle is offset, the density fluctuation component of the photoreceptor rotary cycle can be extracted. To increase an offset proportion of the amplitude of the density fluctuation component other than the photoreceptor rotary cycle, the density fluctuation is preferably calculated from as many density fluctuation profiles as possible of the photoreceptor rotary cycle.

In order to control the developing bias to be applied to the developing roller according to the density fluctuation from the stored average density fluctuation profile of one cycle of the photoreceptor, the stored density fluctuation data of one cycle of the photoreceptor is converted to a parameter to control the output voltage of the development high-voltage power supply and is stored as a control table to the memory 55 in steps S21 and S22, respectively. A duty value of the PWM control signal or a count value to be set in a register of the CPU when the PWM control is performed, and a voltage setting value to control the high-voltage power supply when analog control is performed are considered as a parameter to control the high-voltage power supply 53. Based on the generated control table, the developing bias is controlled by the photoreceptor rotary cycle according to the density fluctuation so that an output image from which the density fluctuation due to the photoreceptor rotary cycle is removed is formed in step S23.

Figure 10:
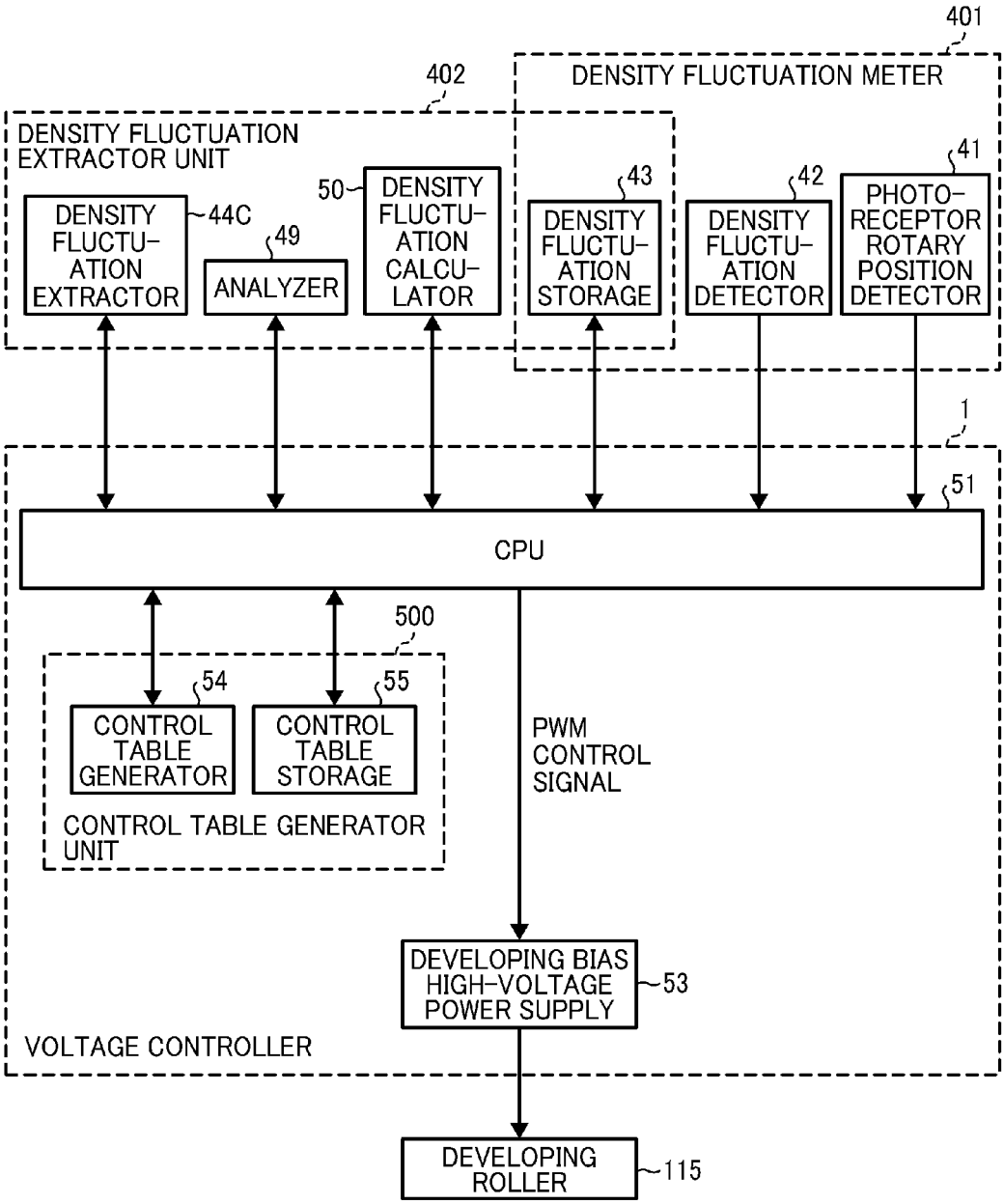
FIG. 10 is a block diagram illustrating a structure of a third embodiment for executing a density fluctuation correction.

FIG. 10 is a block diagram illustrating a structure of a third embodiment for executing a density fluctuation correction.

In FIG. 10, the density fluctuation correction means includes a density fluctuation meter 401 to measure the density fluctuation of the photoreceptor in the rotation direction and a density fluctuation extractor unit 402 to extract the density fluctuation of the cyclic components due to the rotary cycle of the photoreceptor.

The density fluctuation meter 401 includes a rotary position detector 41 to detect a reference rotary position of the photoreceptor; a density fluctuation detector 42 to detect a density fluctuation in the rotary direction of the photoreceptor; and a density fluctuation storage 43 to store the detected density fluctuation.

The density fluctuation extractor unit 402 includes a density fluctuation extractor 44C to extract a density fluctuation of the photoreceptor rotary cycle; an analyzer 49 to extract an amplitude and a phase of an n-th component of the density fluctuation when the rotary cycle of the photoreceptor is set to 1 based on the rotary position detection signal of the photoreceptor in the rotation direction from the extracted density fluctuation of the photoreceptor rotary cycle; a density fluctuation calculator 50 to calculate a density fluctuation profile of one cycle of the photoreceptor from the n-th component of the amplitude and the phase of the density fluctuation; and the density fluctuation storage 43 to store the calculated density fluctuation.

Because the voltage controller 1 and the control table generator unit 500 are identical to the first and second embodiments, the description thereof will be omitted.

Figure 11:
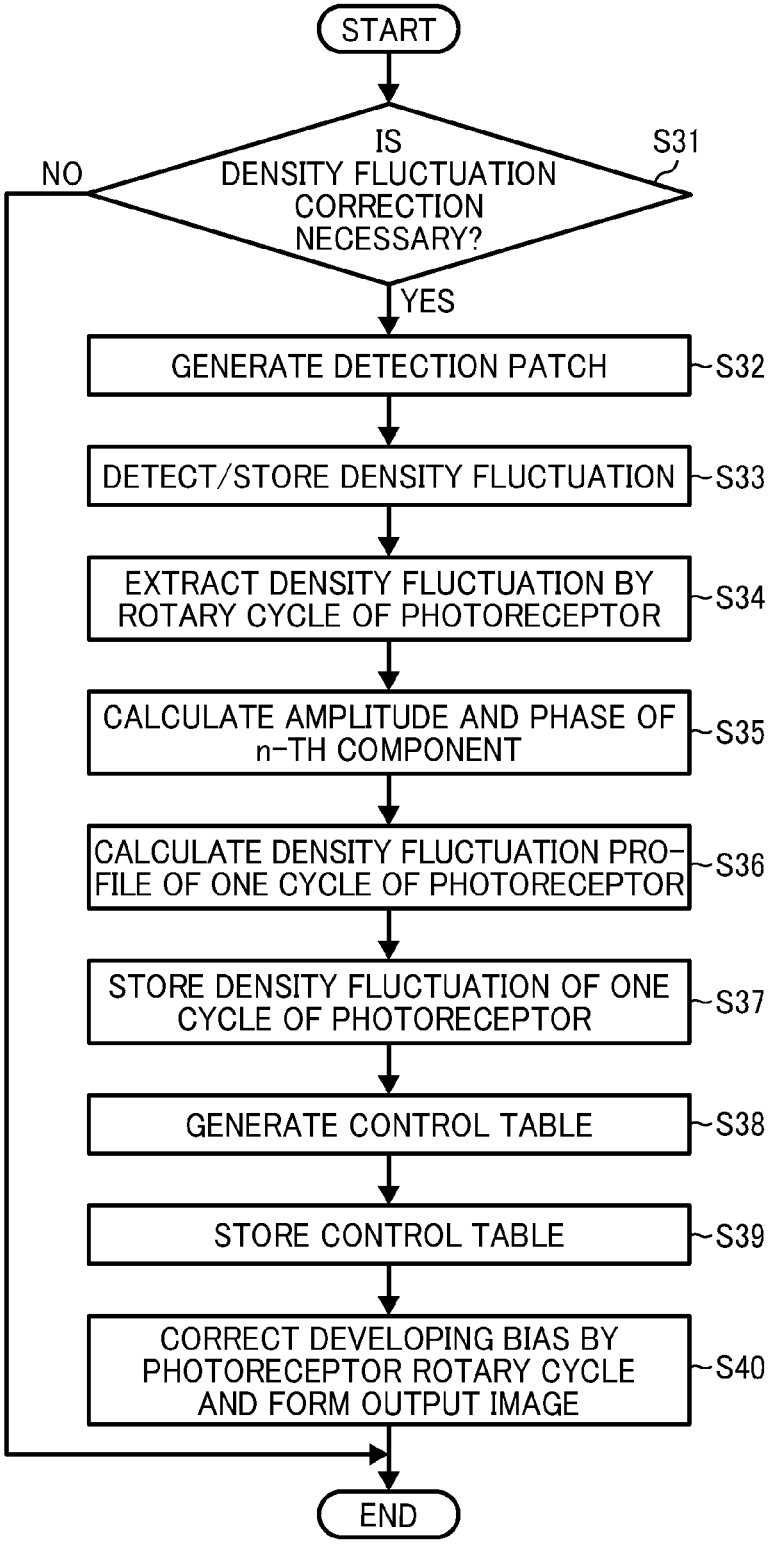
FIG. 11 is a flowchart illustrating a correction process in the third embodiment.

Next, a density fluctuation correction process according to the third embodiment will now be described with reference to a flowchart of FIG. 11.

First, whether a density fluctuation correction is necessary or not is determined in step S31, which identical to step S1 in FIG. 7.

If it is determined that the density fluctuation correction is necessary, the belt-shaped pattern (detection patch) is generated in step S32 and the density fluctuation is detected and stored in step S33. The detection means in this case may be a density sensor or a structure in which a density output on a sheet of paper is detected. The detected density fluctuation data is extracted by the rotary cycle of the photoreceptor based on the rotary position detection signal of the photoreceptor in the rotation direction in step S34.

Next, by removing the density fluctuation component not caused by the rotary cycle of the photoreceptor from the extracted density fluctuation of the photoreceptor rotary cycle, the density fluctuation component due to the rotary cycle of the photoreceptor is extracted in step S35. Specifically, an amplitude and a phase of the n-th component of the density fluctuation when the rotary cycle of the photoreceptor is set to 1 is extracted from the density fluctuation of the extracted photoreceptor rotary cycle based on the rotary position detection signal of the photoreceptor in the rotation direction in step S35. As a method, the density fluctuation profile extracted by the photoreceptor rotary cycle is subjected to a calculation process of the fast Fourier transformation (FFT) process or the orthogonal waveform detection, and the amplitude and the phase of the n-th component of the photoreceptor basic rotation frequency are calculated.

Figure 12A:
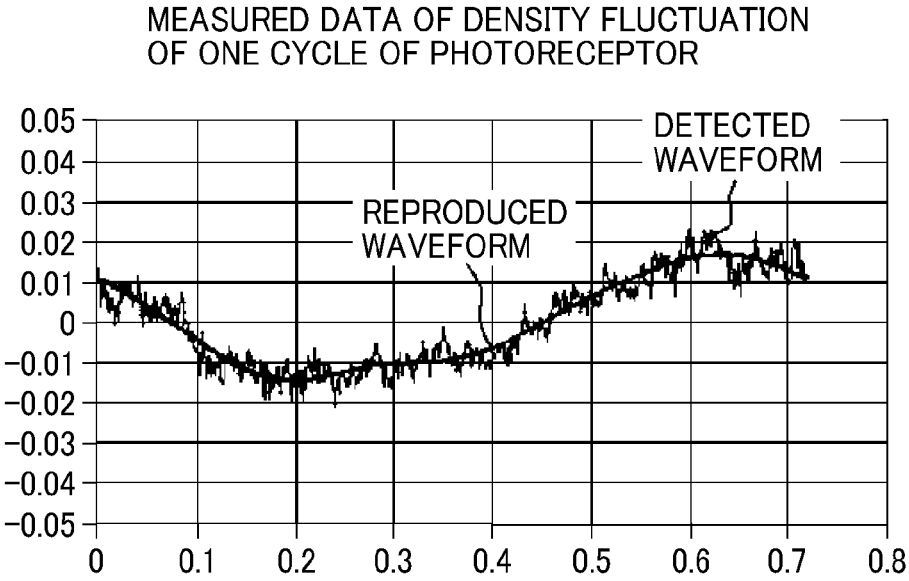
FIG. 12A shows an example of density fluctuation for one cycle of the photoreceptor and FIG. 12B is a graph of n-th components (n=1 to 4) of the rotational frequency of the photoreceptor broken down into a sinusoidal wave.
Figure 12B:
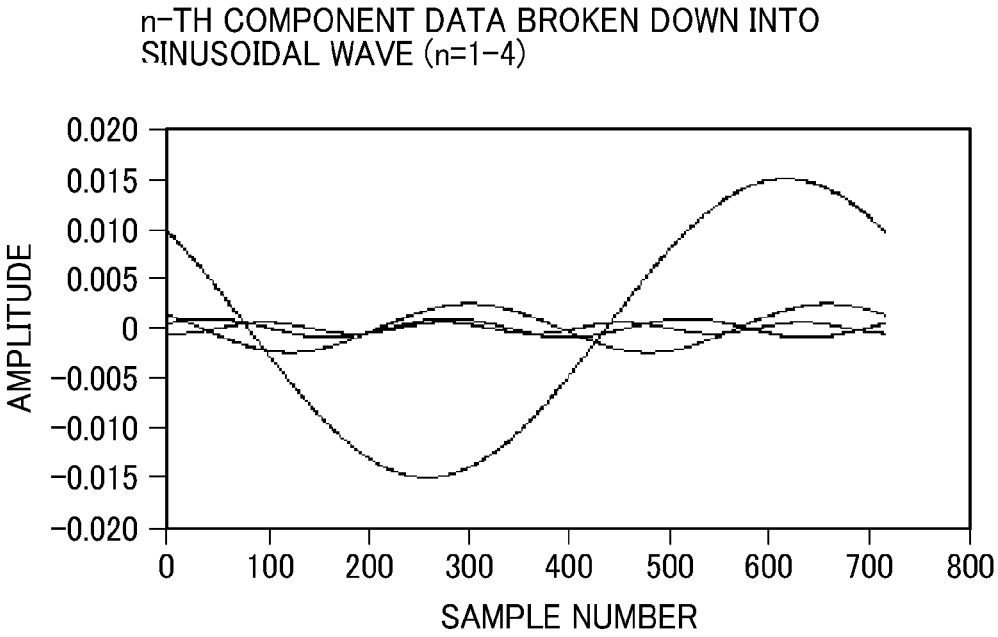

FIG. 12A shows an example of the density fluctuation data of one cycle of the photoreceptor. FIG. 12B is a graph of n-th components (n=1 to 4) of the rotational frequency of the photoreceptor broken down into a sinusoidal wave obtained by analyzing the density fluctuation data in FIG. 12A.

Then, a synthesized waveform is obtained by extracting only the density fluctuation component due to the photoreceptor cycle from the calculated amplitude and phase of the n-th components and the obtained synthesized waveform is set as a density fluctuation profile in step S36. The calculated density fluctuation profile of one cycle of the photoreceptor due to the photoreceptor rotary cycle is stored in the memory 43 in step S37.

Figure 13A:
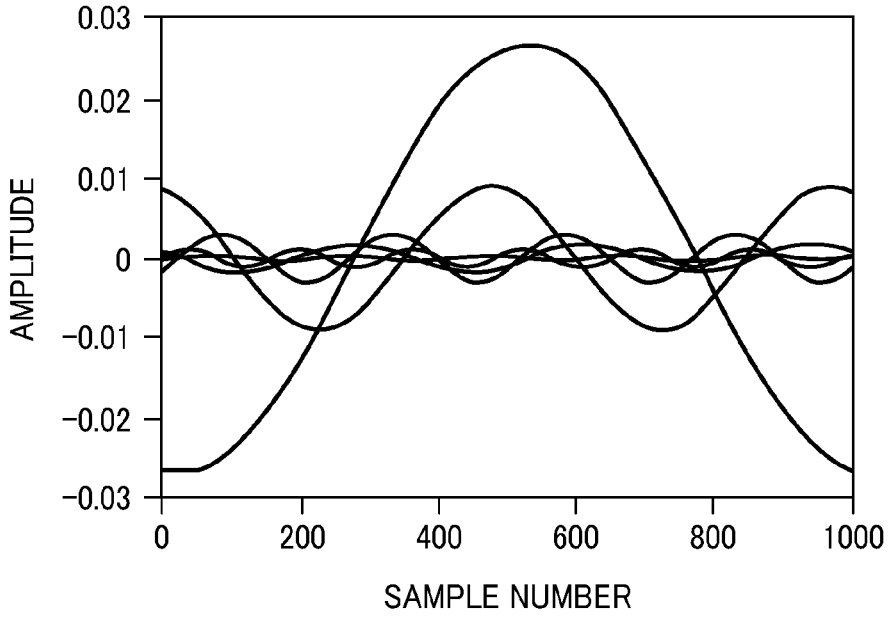
FIG. 13A is a graph of n-th components (n=1 to 4) of the rotational frequency of the photoreceptor broken down into a sinusoidal wave and FIG. 13B shows an example of a synthesized waveform (or a control table waveform) from waveforms in FIG. 13A.
Figure 13B:
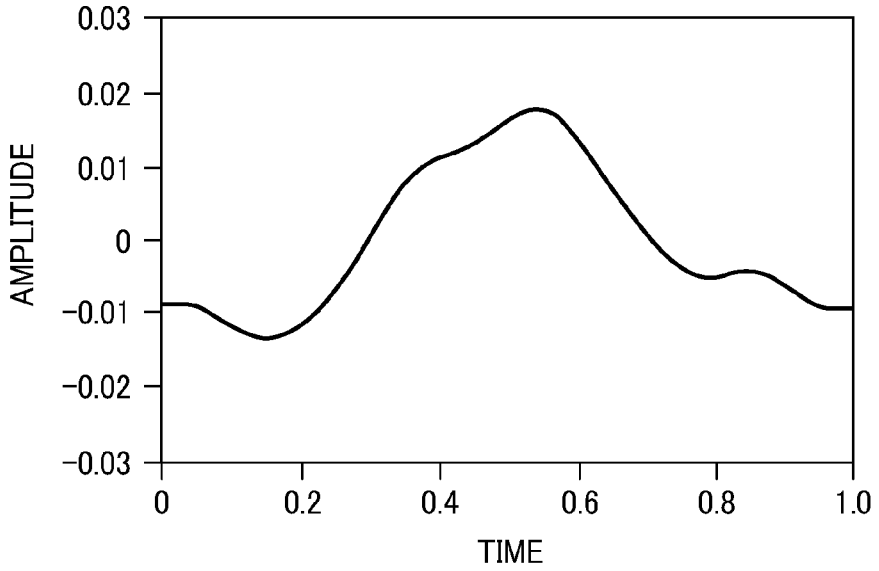

FIG. 13A is a graph of n-th components (n=1 to 4) of the rotational frequency of the photoreceptor broken down into a sinusoidal wave and FIG. 13B shows an example of a synthesized waveform or a control table waveform from waveforms in FIG. 13A.

In order to control the developing bias to be applied to the developing roller according to the density fluctuation from the stored density fluctuation profile of one cycle of the photoreceptor, the stored density fluctuation data of one cycle of the photoreceptor is converted to a parameter to control the output voltage of the development high-voltage power supply and is stored as a control table to the memory 55 in steps S38 and S39. A duty value of the PWM-control signal or a count value to be set in a register of the CPU when the PWM control is performed, and a voltage setting value to control the high-voltage power supply when analog control is performed are considered as each parameter to control the high-voltage power supply. Based on the generated control table, the developing bias is controlled by the photoreceptor rotary cycle according to the density fluctuation so that an output image from which the density fluctuation due to the photoreceptor rotary cycle is removed is formed in step S40.

Figure 14:
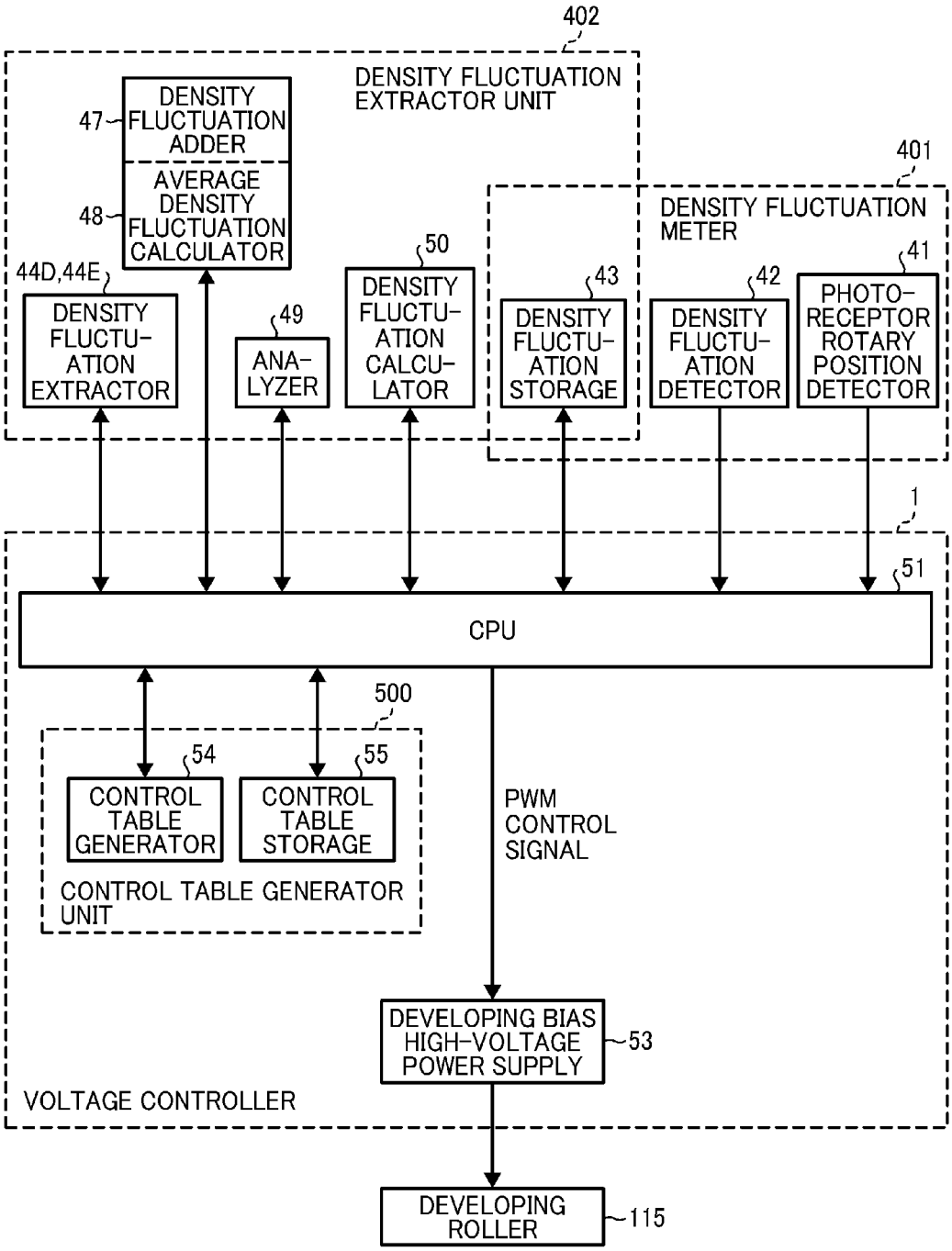
FIG. 14 is a block diagram illustrating a structure of a fourth embodiment for executing a density fluctuation correction.

FIG. 14 is a block diagram illustrating a structure of a fourth embodiment for executing a density fluctuation correction.

In FIG. 14, the density fluctuation correction means includes a density fluctuation meter 401 to measure the density fluctuation of the photoreceptor in the rotation direction and a density fluctuation extractor unit 402 including an average density fluctuation extractor to extract an average density fluctuation due to the rotary cycle of the photoreceptor and a density fluctuation extractor to extract a density fluctuation of the cyclic component due to the rotary cycle of the photoreceptor.

The density fluctuation meter 401 is configured as described above.

The density fluctuation extractor to extract a density fluctuation of the cyclic component due to the rotary cycle of the photoreceptor includes a density fluctuation extractor 44D to extract a density fluctuation of the photoreceptor rotary cycle from the stored density fluctuation; an analyzer 49 to extract an amplitude and a phase of an n-th component of the density fluctuation when the rotary cycle of the photoreceptor is set to 1 based on the rotary position detection signal of the photoreceptor in the rotation direction from the extracted density fluctuation of the photoreceptor rotary cycle; a density fluctuation calculator 50 to calculate a density fluctuation profile of one cycle of the photoreceptor from the amplitude and the phase of the n-th component of the density fluctuation; and the density fluctuation storage 43 to store the calculated density fluctuation.

The average density fluctuation extractor to extract an average density fluctuation due to the rotary cycle of the photoreceptor includes a density fluctuation extractor 44E to extract a density fluctuation of each rotary cycle of the photoreceptor based on the rotary position detection signal of the photoreceptor in the rotation direction from the stored density fluctuation for several rotary cycles of the photoreceptor; a density fluctuation adder 47 to superimpose the extracted density fluctuation profiles for each photoreceptor rotary cycle; an average density fluctuation calculator 48 to calculate an average density fluctuation profile for one cycle of the photoreceptor from the superimposed density fluctuation profiles; and the density fluctuation storage 43 to store the calculated density fluctuation.

Because the voltage controller 1 and the control table generator unit 500 are identical to the first to third embodiments, the description thereof will be omitted.

Figure 15:
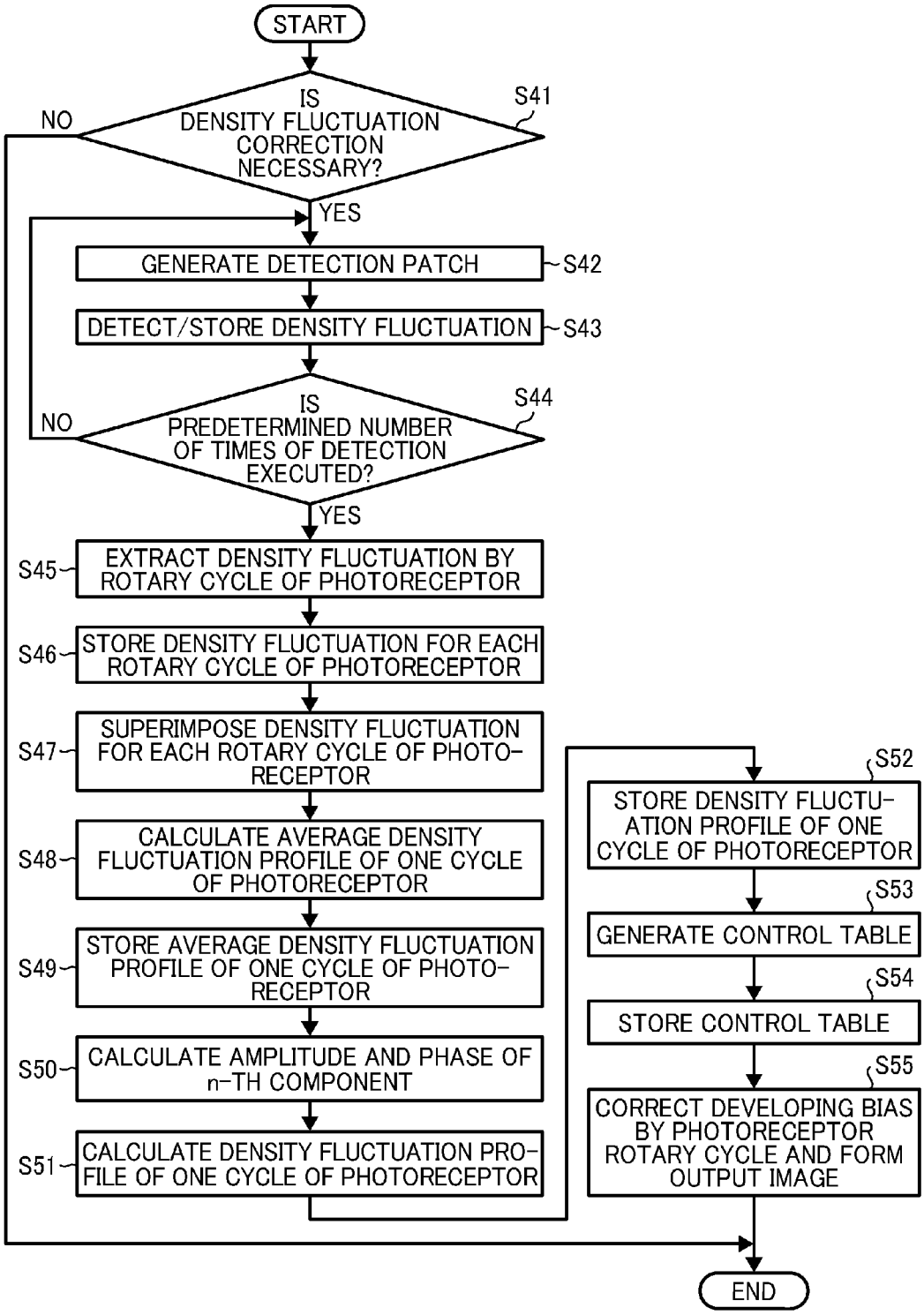
FIG. 15 is a flowchart illustrating a correction process in the fourth embodiment.

Next, a density fluctuation correction process according to the fourth embodiment will now be described with reference to a flowchart in FIG. 15.

First, whether a density fluctuation correction is necessary or not is determined in step S41, which is identical to step S1.

If it is determined that the density fluctuation correction is necessary, the belt-shaped pattern (detection patch) is generated in step S42 and the density fluctuation is detected and stored in step S43. The detection means in this case may be a density sensor or a structure in which a density output on a sheet of paper is detected. The detected density fluctuation data is extracted and stored such that the position of the photoreceptor in the rotation direction can be recognized based on the rotary position detection signal of the photoreceptor in the rotation direction.

After the density fluctuation has been detected and the data has been stored, the belt-shaped pattern is formed in the similar manner and the density fluctuation is detected. The detected density fluctuation data is stored such that the position of the photoreceptor in the rotation direction can be recognized based on the rotary position detection signal of the photoreceptor in the rotation direction.

Thus, at least the density fluctuation of one cycle of the photoreceptor is detected for each measurement up to a predetermined measurement number of times and is stored. As illustrated in FIG. 15 showing a flowchart, the detection and storage number of times are checked in step S44. The detected density fluctuation data is extracted by the rotary cycle of the photoreceptor based on the rotary position detection signal of the photoreceptor in the rotation direction in step S45 and is stored in the memory or storage 43 in step S46.

The density fluctuation profile for each rotary cycle of the photoreceptor is extracted based on the rotary position detection signal of the photoreceptor in the rotation direction from the stored density fluctuation of the several rotations of the photoreceptor, and the density fluctuation profiles extracted for the photoreceptor rotary cycle are superimposed in step S47. Then, from the superimposed density fluctuation profile, the average density fluctuation profile for one cycle of the photoreceptor is calculated in step S48. The average density fluctuation profile of one cycle of the photoreceptor due to the calculated photoreceptor rotary cycle is stored in the memory 43 in step S49.

Next, by removing the density fluctuation component not caused by the rotary cycle of the photoreceptor from the extracted density fluctuation of the photoreceptor rotary cycle, the density fluctuation component due to the rotary cycle of the photoreceptor is extracted in step S50. Specifically, in step S50, an amplitude and a phase of the n-th component of the density fluctuation when the rotary cycle of the photoreceptor is set to 1 is extracted from the density fluctuation of the extracted photoreceptor rotary cycle based on the rotary position detection signal of the photoreceptor in the rotation direction. As a method, the density fluctuation profile extracted by the photoreceptor rotary cycle is subjected to a calculation process of the fast Fourier transformation (FFT) process or the orthogonal waveform detection, and the amplitude and the phase of the n-th component of the photoreceptor basic rotation frequency are calculated.

Then, a synthesized waveform is obtained by extracting only the density fluctuation component due to the photoreceptor rotary cycle from the calculated amplitude and phase of the n-th components and the synthesized waveform is set as a density fluctuation profile in step S51. The density fluctuation profile of one cycle of the photoreceptor due to the calculated photoreceptor rotary cycle is stored in the memory 43 in step S52.

In order to control the developing bias to be applied to the developing roller according to the density fluctuation from the stored density fluctuation profile of one cycle of the photoreceptor, the stored density fluctuation data of one cycle of the photoreceptor is converted to a parameter to control the output voltage of the development high-voltage power supply and is stored as a control table to the memory in steps S53 and S54. A duty value of the PWM control signal or a count value to be set in a register of the CPU when the PWM control is performed, and a voltage setting value to control the high-voltage power supply when analog control is performed are considered as each parameter to control the high-voltage power supply.

Based on the generated control table, the developing bias is controlled by the photoreceptor rotary cycle according to the density fluctuation so that an output image from which the density fluctuation due to the photoreceptor rotary cycle is removed is formed in step S55.

Figure 16:
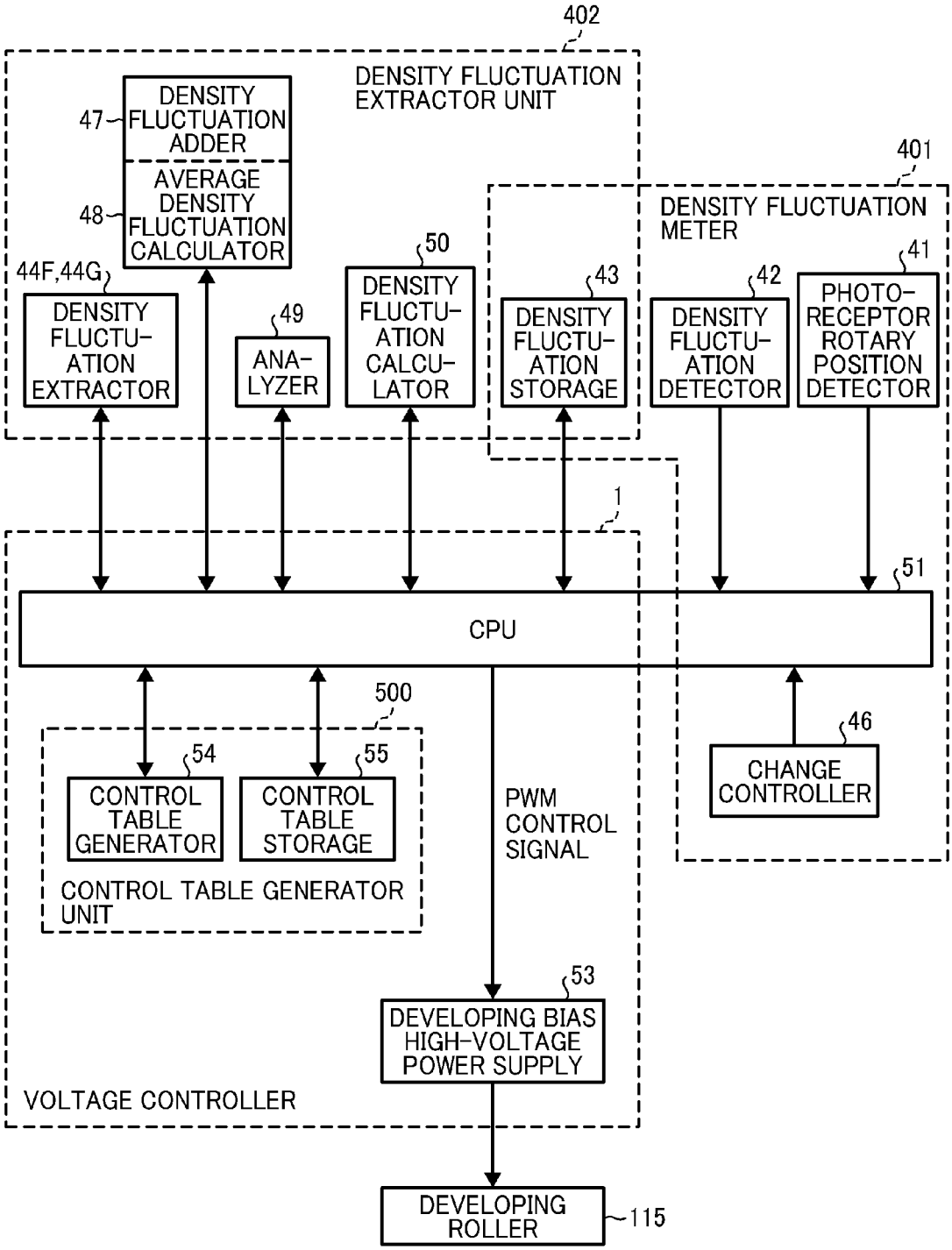
FIG. 16 is a block diagram illustrating a structure of a fifth embodiment for executing a density fluctuation correction.

FIG. 16 is a block diagram illustrating a structure of a fifth embodiment for executing a density fluctuation correction.

In FIG. 16, the density fluctuation correction means includes a density fluctuation meter 401 to measure the density fluctuation of the photoreceptor in the rotation direction, a density fluctuation extractor unit 402 including an average density fluctuation extractor to extract an average density fluctuation due to the rotary cycle of the photoreceptor and a density fluctuation extractor to extract a density fluctuation of the cyclic component due to the rotary cycle of the photoreceptor, and further a change controller 46 to change relative positions of the photoreceptor and the developing roller.

The density fluctuation meter 401 is configured as described above.

The density fluctuation extractor to extract a density fluctuation of the cyclic component due to the rotary cycle of the photoreceptor includes a density fluctuation extractor 44F to extract a density fluctuation of the photoreceptor rotary cycle from the stored density fluctuation; an analyzer 49 to extract an amplitude and a phase of an n-th component of the density fluctuation when the rotary cycle of the photoreceptor is set to 1 based on the rotary position detection signal of the photoreceptor in the rotation direction from the extracted density fluctuation of the photoreceptor rotary cycle; a density fluctuation calculator 50 to calculate a density fluctuation profile of one cycle of the photoreceptor from the amplitude and the phase of the n-th component of the density fluctuation; and a density fluctuation storage 43 to store the calculated density fluctuation.

The average density fluctuation extractor due to the rotary cycle includes a density fluctuation extractor 44G to extract a density fluctuation of each rotary cycle of the photoreceptor based on the rotary position detection signal of the photoreceptor in the rotation direction from the stored density fluctuation for several rotary cycles of the photoreceptor; a density fluctuation adder 47 to superimpose the extracted density fluctuation profiles for each photoreceptor rotary cycle; an average density fluctuation calculator 48 to calculate an average density fluctuation profile for one cycle of the photoreceptor from the superimposed density fluctuation profiles; and the density fluctuation storage 43 to store the calculated density fluctuation.

Because the voltage controller 1 and the control table generator unit 500 are identical to the first embodiment, the description thereof will be omitted.

Figure 17:
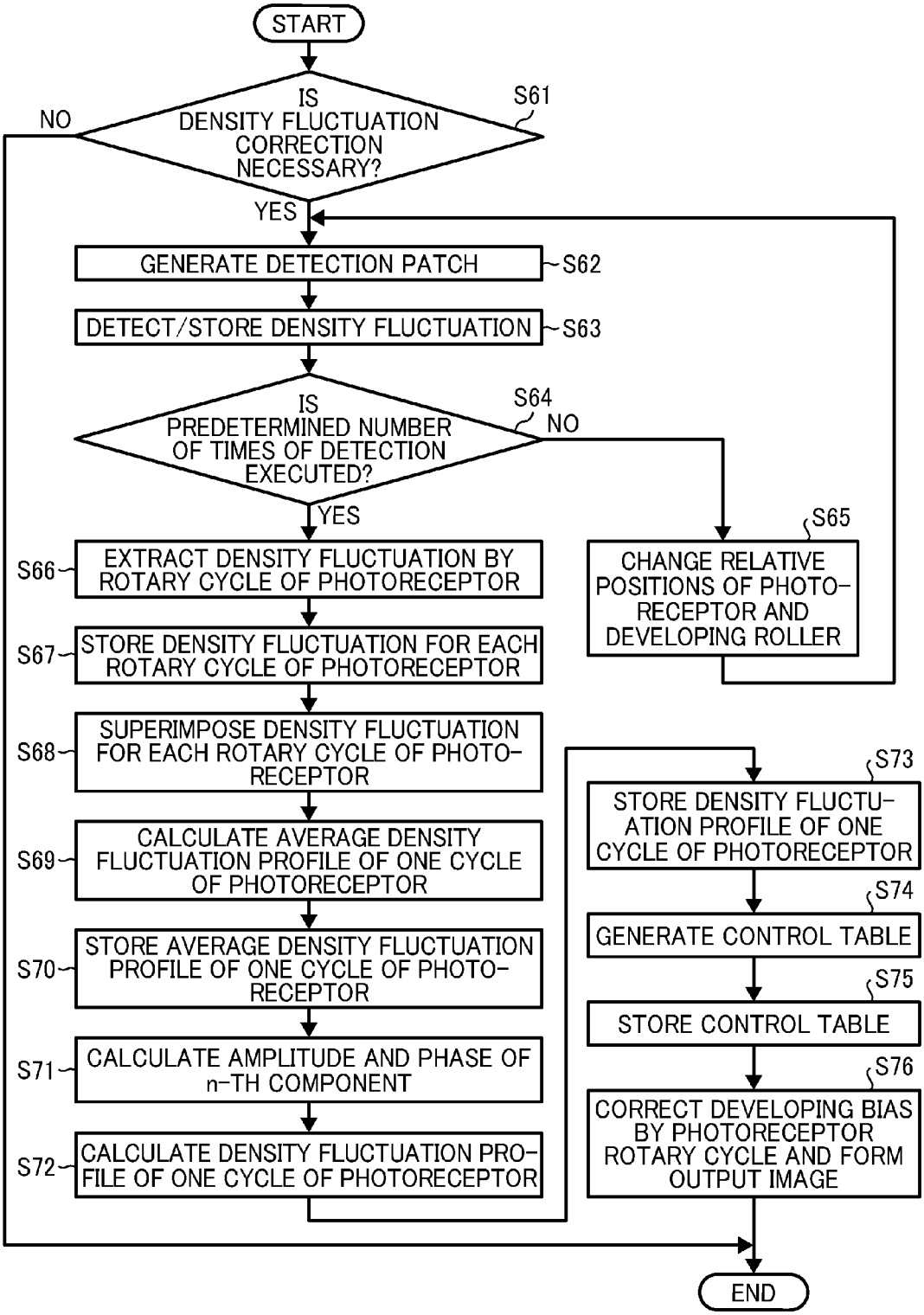
FIG. 17 is a flowchart illustrating a correction process in the fifth embodiment.

Next, a density fluctuation correction process according to the fifth embodiment will now be described with reference to a flowchart in FIG. 17.

First, whether a density fluctuation correction is necessary or not is determined in step S61, which is identical to step S1

If it is determined that the density fluctuation correction is necessary, the belt-shaped pattern (detection patch) is generated in step S62 and the density fluctuation is detected and stored in step S63. The detection means in this case may be a density sensor or a structure in which a density output on a sheet of paper is detected. The detected density fluctuation data is extracted and stored such that the position of the photoreceptor in the rotation direction can be recognized based on the rotary position detection signal of the photoreceptor in the rotation direction.

After the density fluctuation is detected and the data is stored, relative positions of the photoreceptor and the developing roller are changed, the belt-shaped pattern is formed again in a similar manner, and the density fluctuation is detected. In order to change the relative positions of the photoreceptor and the developing roller, for example, the photoreceptor and the developing roller are temporarily stopped and either one is rotated a little. After the photoreceptor and the developing roller have been again driven, the belt-shaped pattern is generated and the density fluctuation is detected. The method to change the relative positions of the photoreceptor and the developing roller is not limited to this, but any method capable of changing the relative positions may be used. The detected density fluctuation data is extracted and stored such that the position of the photoreceptor in the rotation direction can be recognized based on the rotary position detection signal of the photoreceptor in the rotation direction.

Thus, the relative positions of the photoreceptor and the developing roller are changed and the density fluctuation data is detected up to a predetermined number of times, and at least the density fluctuation of one cycle of the photoreceptor is detected for each measurement and is stored. In the flowchart, the number of times is checked in step S64 and relative positions of the photoreceptor and the developing roller are changed in step S65.

The detected density fluctuation data is extracted by the rotary cycle of the photoreceptor based on the rotary position detection signal of the photoreceptor in the rotation direction in step S66 and is stored in the memory or storage 43 in step S67.

The density fluctuation profile for each rotary cycle of the photoreceptor is extracted based on the rotary position detection signal of the photoreceptor in the rotation direction from the stored density fluctuation of the several rotations of the photoreceptor, and the density fluctuation profiles with different phase of the photoreceptor and the developing roller extracted each time the photoreceptor rotary cycle are superimposed in step S68. Then, from the superimposed density fluctuation profiles, the average density fluctuation profile for one cycle of the photoreceptor is calculated in step S69. The average density fluctuation profile of one cycle of the photoreceptor due to the calculated photoreceptor rotary cycle is stored in the memory 43 in step S70.

Next, by removing the density fluctuation component not caused by the rotary cycle of the photoreceptor from the extracted density fluctuation of one cycle of the photoreceptor, the density fluctuation component due to the rotary cycle of the photoreceptor is extracted. Specifically, in step S71, an amplitude and a phase of the n-th component of the density fluctuation when the rotary cycle of the photoreceptor is set to 1 is extracted from the density fluctuation of the extracted photoreceptor rotary cycle based on the rotary position detection signal of the photoreceptor in the rotation direction. As a method for extraction, the density fluctuation profile extracted by the photoreceptor rotary cycle is subjected to a calculation process of the fast Fourier transformation (FFT) process or the orthogonal waveform detection, and the amplitude and the phase of the n-th component of the photoreceptor basic rotation frequency are calculated.

Then, a synthesized waveform is obtained by extracting only the density fluctuation component due to the photoreceptor rotary cycle from the calculated amplitude and phase of the n-th components and the synthesized waveform is set as a density fluctuation profile in step S72. The density fluctuation profile of one cycle of the photoreceptor due to the calculated photoreceptor rotary cycle is stored in the memory 43 in step S73.

In order to control the developing bias to be applied to the developing roller according to the density fluctuation from the stored density fluctuation profile of one cycle of the photoreceptor, the stored density fluctuation data of one cycle of the photoreceptor is converted to a parameter to control the output voltage of the development high-voltage power supply and is stored as a control table to the memory in steps S74 and S75. A duty value of the PWM control signal or a count value to be set in a register of the CPU when the PWM control is performed, and a voltage setting value to control the high-voltage power supply when analog control is performed are considered as each parameter to control the high-voltage power supply.

Based on the generated control table, the developing bias is controlled by the photoreceptor rotary cycle according to the density fluctuation so that an output image from which the density fluctuation due to the photoreceptor rotary cycle is removed is formed in step S76.

Figure 18:
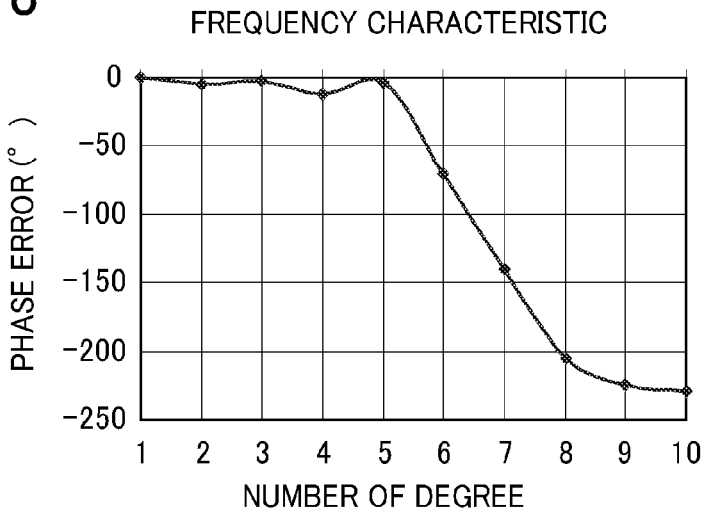
FIG. 18 is a graph showing a phase error of the n-th components when the basic rotational cycle of the photoreceptor is set to 1.

FIG. 18 is a graph showing a phase error of the n-th components when the basic rotational cycle of the photoreceptor is set to 1. A horizontal axis of the graph shows a number of degrees and a vertical axis shows a phase error.

This graph shows a result of calculation in the image forming apparatus of FIG. 1, in which in order to control the developing bias, a PWM control signal applied with a constant frequency modulation is input to the development high-voltage power supply 53 and the n-th component phase error is calculated. The constant frequency is obtained by multiplying by 1, 2, . . . , 10 when the basic rotational frequency of the photoreceptor is assumed to be 1.

As illustrated in FIG. 18, if the number of degree is from 1 to 5, the phase error can be seen rarely, but in the higher harmonics of greater than 6, the phase shifts and the developing bias cannot be controlled. Then, by creating a control table using only the components below the n-th higher harmonics being below the previously set phase error, the density fluctuation of the photoreceptor rotary cycle can be removed, and an optimal correction can be performed without creating any new density fluctuation. In this frequency characteristic, a control table is created using synthesized waveforms from the 1st to 5th components with less phase errors.

As described heretofore, a table to correct only the density fluctuation components due to the photoreceptor rotary cycle is created based on the density fluctuation data detected by the density fluctuation detector; based on the correction table, the developing bias is changed by the photoreceptor rotary cycle so as to output an image; and the density fluctuation caused by other than the photoreceptor rotary cycle can be removed. Thus, even though the phase relation between the photoreceptor and the developing roller changes, the density fluctuation due to the rotary cycle and the oscillation of the higher degree components of the rotary cycle of the photoreceptor can be removed. Accordingly, a high-quality image without any density fluctuation and with a uniform image density in one page can be obtained.

Figure 19A:
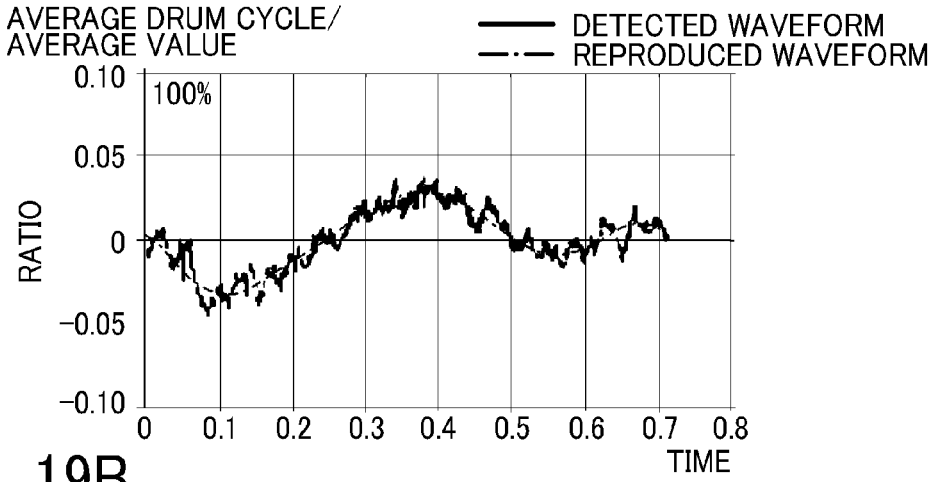
FIGS. 19A and 19B are graphs each illustrating an example of correction using a control table.
Figure 19B:
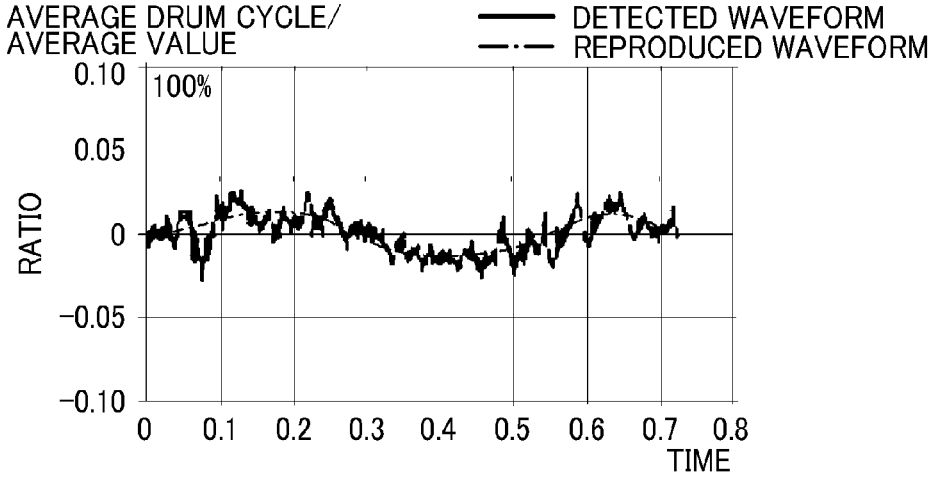
Figure 20:
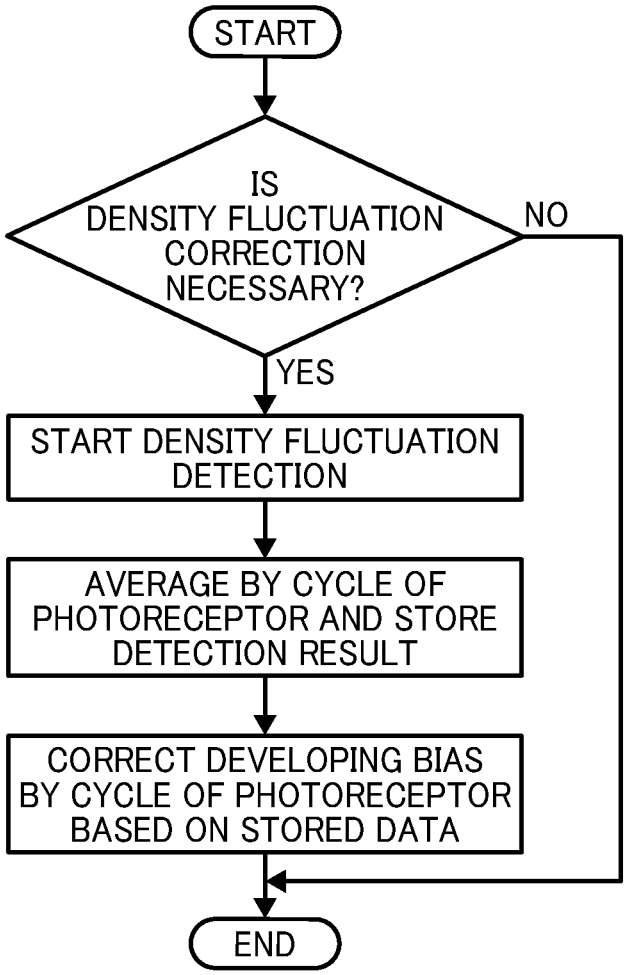
FIG. 20 BACKGROUND ART
FIG. 20 is a flowchart illustrating a conventional density fluctuation correction method.
Figure 21A:
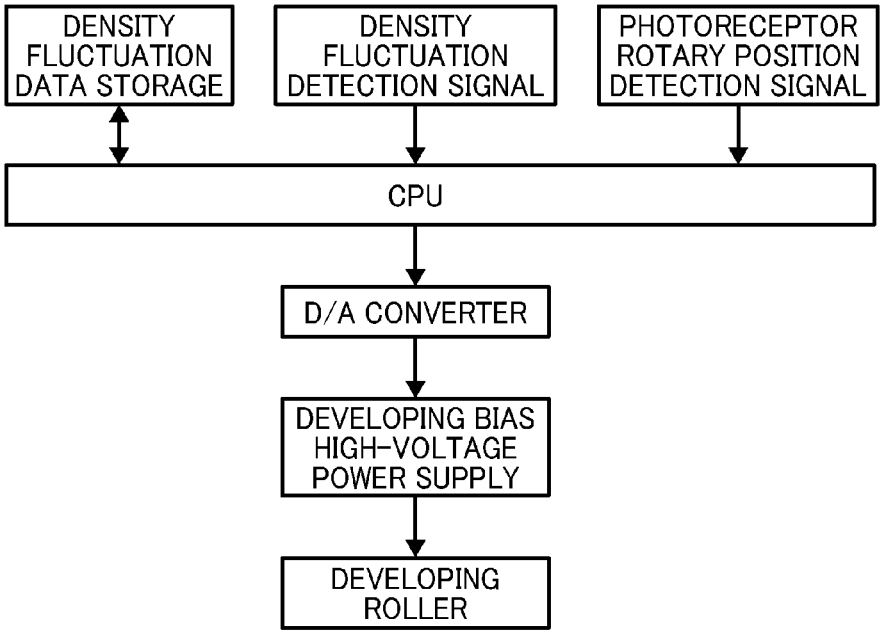
FIG. 21A BACKGROUND ART
FIGS. 21A and 21B are block diagrams each illustrating a device configuration for executing the conventional density fluctuation correction method of FIG. 20.
Figure 21B:
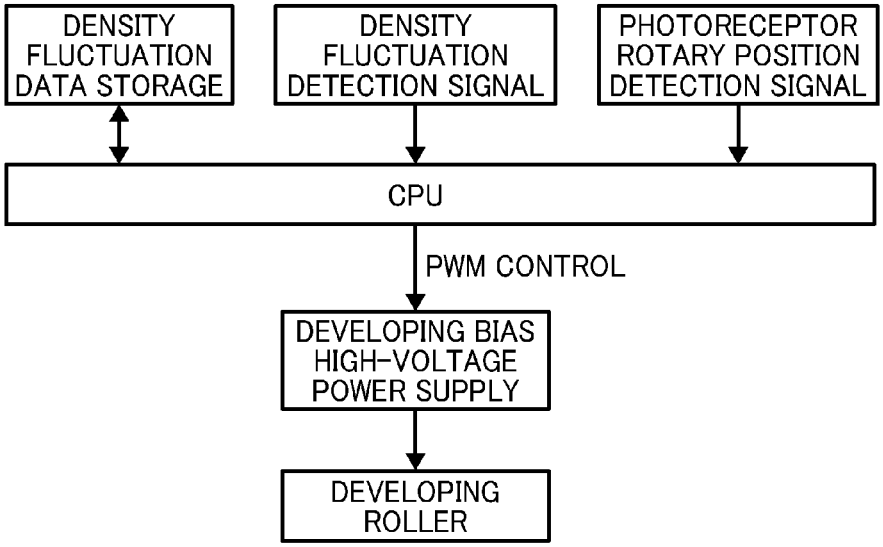
FIG. 21B BACKGROUND ART
Figure 22:
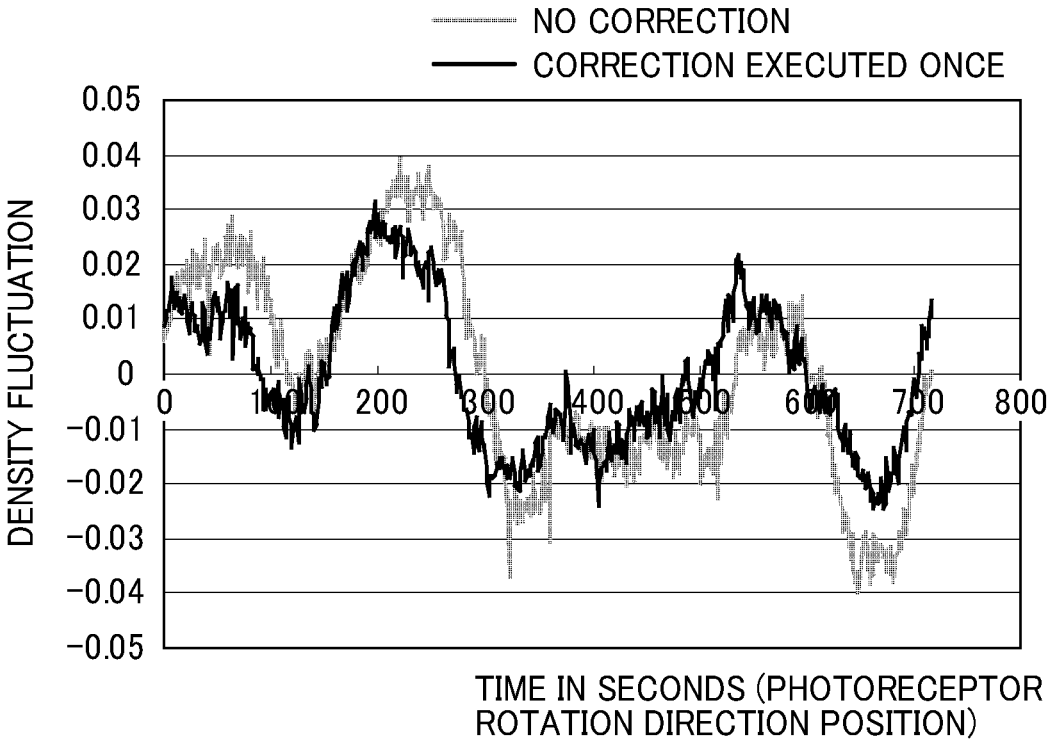
FIG. 22 BACKGROUND ART
FIG. 22 shows an example of the correction results executed by the conventional density fluctuation correction method of FIG. 20.

FIGS. 19A and 19B are graphs each illustrating an example of correction using a control table.

In each of the graphs of FIGS. 19A and 19B, the vertical axis shows a density fluctuation (being a ratio in which an average drum cycle is divided by an average value) and the horizontal axis shows time in seconds. In addition, the solid line shows a detected waveform and the broken line shows a reproduced waveform. FIG. 19B shows a corrected density fluctuation using the control table from the waveform (with no correction) applied with a predetermined constant developing bias as illustrated in FIG. 19A.

Heretofore, the present invention has been described with reference to drawings, but is not limited to only the aforementioned embodiments. For example, the structure of the voltage controller to correct the density fluctuation is not limited to the described embodiments, but any arbitrary structure may be adopted. In addition, the structure of the density sensor may be changed arbitrarily. Without limiting the present invention to a structure detecting the toner deposition amount on the photoreceptor or the intermediate transfer belt, a structure to detect the image density on a sheet of paper may also be adopted. The density fluctuation detection pattern is not limited to the as-described examples. The structure of the developing device can be modified as necessary or convenient.

In addition, the structure of the image forming apparatus is also arbitrary and the order of color process cartridges is also arbitrary. The present invention may be applied not only to a tandem-type image forming apparatus, but to an apparatus in which a plurality of developing device are arranged around one photoreceptor or the apparatus using a revolving-type developing device. The present invention may also be applied to a full-color apparatus using three colors of toner, two colors of toner, or a monochrome machine. The present invention is not limited to a copier but is also applicable to a printer, a facsimile machine, or a multi-function apparatus having one or more capabilities of the above devices.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an image carrier;

a developing device;

a transfer device;

a fixing device, wherein an electrostatic latent image formed on the image carrier is rendered visible as a toner image by depositing toner thereon by the developing device and the toner image is transferred by the transfer device and fixed onto a recording medium by the fixing device and output;

a density fluctuation meter including a rotary position detector to detect a position of the image carrier in a rotation direction; a density fluctuation detector to detect the density fluctuation of the image carrier in the rotation direction; and a density fluctuation storage to store the density fluctuation detected by the density fluctuation detector;

a density fluctuation extractor unit, including:

a density fluctuation extractor to extract a density fluctuation of the image carrier rotary cycle;

an analyzer to extract an amplitude and a phase of an n-th component of the density fluctuation when the rotary cycle of the image carrier is set to 1 based on the rotary position detection signal of the image carrier in the rotation direction from the extracted density fluctuation of the image carrier rotary cycle;

a density fluctuation calculator to calculate a density fluctuation profile of one cycle of the image carrier from the n-th component of the amplitude and the phase of the density fluctuation; and a density fluctuation storage to store the calculated density fluctuation; and a control table generator unit to generate a control table including:

a control table generator to calculate a voltage to be applied to the developing device based on the density fluctuation data of one cycle of the image carrier stored in the storage; and a control table storage to store the generated control table, the voltage to be applied to the developing device being controlled and the toner image output based on the control table stored in the control table storage, wherein the control table is created by using only the components below the n-th higher harmonics being below a previously set phase error when the basic rotational cycle of the image carrier is set to 1.

2. The image forming apparatus according to claim 1, wherein the density fluctuation extractor unit comprises:

a first extractor to extract the density fluctuation of the image carrier in the rotation direction based on the detected position by the rotary position detector from the density fluctuation stored by the density fluctuation storage;

a second extractor to extract the density fluctuation for only the rotary cycle components by removing the density fluctuation component not caused by the rotary cycle of the image carrier from the density fluctuation of the image carrier in the rotation direction extracted in the first extractor; and a density fluctuation storage to store the extracted density fluctuation.

3. The image forming apparatus according to claim 1, further comprising a change, controller to change relative positions of the image carrier and the developing device each time the measurement is performed when the density fluctuation of the image carrier in the rotation direction is measured several times, wherein the density fluctuation extractor unit includes:

the density fluctuation extractor to extract density fluctuation of each rotary cycle of the image carrier based on the rotary position detection signal of the image carrier in the rotation direction from the stored density fluctuation for several rotary cycles of the image carrier;

a density fluctuation adder to superimpose the extracted density fluctuation profiles for each image carrier rotary cycle;

an average density fluctuation calculator to calculate an average density fluctuation profile for one cycle of the image carrier from the superimposed density fluctuation profile; and a storage to store the calculated density fluctuation.

4. An image forming apparatus comprising:

an image carrier;

a developing device;

a transfer device;

a fixing device, wherein an electrostatic latent image formed on the image carrier is rendered visible as a toner image by depositing toner thereon by the developing device and the toner image is transferred by the transfer device and fixed onto a recording medium by the fixing device and output;

a density fluctuation meter including a rotary position detector to detect a position of the image carrier in a rotation direction; a density fluctuation detector to detect the density fluctuation of the image carrier in the rotation direction; and a density fluctuation storage to store the density fluctuation detected by the density fluctuation detector;

a density fluctuation extractor unit to extract a density fluctuation of the cyclic component due to the rotary cycle of the image carrier, including:

a density fluctuation extractor to extract a density fluctuation of the image carrier rotary cycle from the stored density fluctuation;

an analyzer to extract an amplitude and a phase of an n-th component of the density fluctuation when the rotary cycle of the image carrier is set to 1 based on the rotary position detection signal of the image carrier in the rotation direction from the extracted density fluctuation of the image carrier rotary cycle;

a density fluctuation calculator to calculate a density fluctuation profile of one cycle of the image carrier from the amplitude and the phase of the n-th component of the density fluctuation; and a density fluctuation storage to store the calculated density fluctuation;

an average density fluctuation extractor unit to extract an average density fluctuation due to the rotary cycle of the image carrier, including:

an average density fluctuation extractor to extract a density fluctuation of each rotary cycle of the image carrier based on the rotary position detection signal of the image carrier in the rotation direction from the stored density fluctuation for several rotary cycles of the image carrier;

a density fluctuation adder to superimpose the extracted density fluctuation profiles for each image carrier rotary cycle;

an average density fluctuation calculator to calculate an average density fluctuation profile for one cycle of the image carrier from the superimposed density fluctuation profiles; and the density fluctuation storage to store the calculated density fluctuation; and a control table generator unit to generate a control table including:

a control table generator to calculate a voltage to be applied to the developing device based on the density fluctuation data of one cycle of the image carrier stored in the storage; and a control table storage to store the generated control table, the voltage to be applied to the developing device being controlled and the toner image output based on the control table stored in the control table storage, wherein the control table is created by using only the components below the n-th higher harmonics being below a previously set phase error when the basic rotational cycle of the image carrier is set to 1.

5. An image forming apparatus comprising: an image carrier; a developing device; a transfer device; and a fixing device, wherein an electrostatic latent image formed on the image carrier is rendered visible as a toner image by depositing the toner by the developing device, the toner image is transferred by the transfer device and fixed onto a recording medium by the fixing device and output, the image forming apparatus further including:

a density fluctuation meter including a rotary position detector to detect a position of the image carrier in a rotation direction, a density fluctuation detector to detect the density fluctuation of the image carrier in the rotation direction, and a density fluctuation storage to store the density fluctuation detected by the density fluctuation detector;

a change controller to change relative positions of the image carrier and the developing device each time the measurement is performed when the density fluctuation of the image carrier in the rotation direction is measured several times;

a density fluctuation extractor unit to extract a density fluctuation of the cyclic component due to the rotary cycle of the image carrier including: a density fluctuation extractor to extract a density fluctuation of the photoreceptor rotary cycle from the stored density fluctuation; an analyzer to extract an amplitude and a phase of an n-th component of the density fluctuation when the rotary cycle of the photoreceptor is set to 1 based on the rotary position detection signal of the photoreceptor in the rotation direction from the extracted density fluctuation of the photoreceptor rotary cycle; a density fluctuation calculator to calculate a density fluctuation profile of one cycle of the photoreceptor from the amplitude and the phase of the n-th component of the density fluctuation; and a density fluctuation storage to store the calculated density fluctuation;

an average density fluctuation extractor unit due to the rotary cycle including an average density fluctuation extractor to extract a density fluctuation of each rotary cycle of the photoreceptor based on the rotary position detection signal of the photoreceptor in the rotation direction from the stored density fluctuation for several rotary cycles of the photoreceptor; a density fluctuation adder to superimpose the extracted density fluctuation profiles for each photoreceptor rotary cycle; an average density fluctuation calculator to calculate an average density fluctuation profile for one cycle of the photoreceptor from the superimposed density fluctuation profiles; and the density fluctuation storage to store the calculated density fluctuation; and a control table generator unit including a control table generator to calculate a voltage to be applied to the developing device based on the average density fluctuation data of one cycle of the image carrier stored in the storage; and a control table storage to store the generated control table, wherein the voltage to be applied to the developing device is controlled and the toner image is output based on the control table stored in the control table storage, and wherein the control table is created by using only the components below the n-th higher harmonics being below a previously set phase error when the basic rotational cycle of the image carrier is set to 1.

* * * * *